US008408725B1

(12) United States Patent
Maxik et al.

(10) Patent No.: US 8,408,725 B1
(45) Date of Patent: Apr. 2, 2013

(54) REMOTE LIGHT WAVELENGTH CONVERSION DEVICE AND ASSOCIATED METHODS

(75) Inventors: Fredric S. Maxik, Indialantic, FL (US); Eric Bretschneider, Satellite Beach, FL (US); Robert R. Soler, Cocoa Beach, FL (US); David E. Bartine, Cocoa, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 0 days.

(21) Appl. No.: 13/234,604

(22) Filed: Sep. 16, 2011

(51) Int. Cl.
*F21V 9/16* (2006.01)

(52) U.S. Cl. ..... 362/84; 362/551; 362/555

(58) Field of Classification Search ..... 362/84, 362/551–582
See application file for complete search history.

(56) References Cited

U.S. PATENT DOCUMENTS 4,097,917 A * 6/1978 McCaslin ..... 362/565
4,206,495 A * 6/1980 McCaslin ..... 362/551
5,057,908 A 10/1991 Weber
5,523,878 A 6/1996 Wallace et al.
5,704,701 A 1/1998 Kavanagh et al.
5,951,140 A * 9/1999 Feldman ..... 362/84
5,997,150 A 12/1999 Anderson
6,140,646 A 10/2000 Busta et al.
6,207,229 B1 * 3/2001 Bawendi et al. ..... 427/215
6,341,876 B1 1/2002 Moss et al.
6,356,700 B1 3/2002 Strobl
6,561,656 B1 5/2003 Kojima et al.
6,594,090 B2 7/2003 Kruschwitz et al.
6,733,135 B2 5/2004 Dho
6,767,111 B1 7/2004 Lai
6,817,735 B2 11/2004 Shimizu et al.
6,870,523 B1 3/2005 Ben-David et al.
6,871,982 B2 3/2005 Holman et al.
6,921,920 B2 * 7/2005 Kazakevich ..... 257/81
6,967,761 B2 11/2005 Starkweather et al.
6,974,713 B2 12/2005 Patel et al.
7,042,623 B1 5/2006 Huibers et al.
7,070,281 B2 7/2006 Kato
7,072,096 B2 7/2006 Holman et al.
7,075,707 B1 7/2006 Rapaport et al.
7,083,304 B2 8/2006 Rhoads et al.
7,178,941 B2 2/2007 Roberge et al.
7,184,201 B2 2/2007 Duncan
7,246,923 B2 7/2007 Conner
7,255,469 B2 8/2007 Wheatley et al.
7,261,453 B2 8/2007 Morejon et al.

(Continued)

OTHER PUBLICATIONS

N. T. Obot, W. J. Douglas, A. S. Muammar, "Effect of Semi-confinement on Impingement Heat Transfer", Proc. 7th Int. Heat Transf. Conf., 1982. pp. 1355-1364, vol. 3.

(Continued)

*Primary Examiner* — Bao Q Truong
(74) *Attorney, Agent, or Firm* — Mark R. Malek, Esq.; Daniel C. Pierron, Esq.; Zies Widerman & Malek

(57) ABSTRACT

A remote light wavelength conversion device is provided for converting a source light emitted from a light source within a source wavelength range into a converted light within a converted wavelength range. The remote light wavelength conversion device may include a waveguide and a color conversion optic. The waveguide may include a first end and a second end and the color conversion optic may be adjacently located at the second end of the waveguide. The color conversion optic may convert the source light transmitted through the waveguide to the converted light.

16 Claims, 14 Drawing Sheets

U.S. PATENT DOCUMENTS

| | | | | |
|---|---|---|---|---|
| 7,289,090 | B2 | 10/2007 | Morgan | |
| 7,300,177 | B2 | 11/2007 | Conner | |
| 7,303,291 | B2 | 12/2007 | Ikeda et al. | |
| 7,325,956 | B2 | 2/2008 | Morejon et al. | |
| 7,342,658 | B2 | 3/2008 | Kowarz et al. | |
| 7,344,279 | B2 | 3/2008 | Mueller et al. | |
| 7,349,095 | B2 | 3/2008 | Kurosaki | |
| 7,353,859 | B2 | 4/2008 | Stevanovic et al. | |
| 7,382,632 | B2 | 6/2008 | Alo et al. | |
| 7,400,439 | B2 | 7/2008 | Holman | |
| 7,427,146 | B2 | 9/2008 | Conner | |
| 7,429,983 | B2 | 9/2008 | Islam | |
| 7,434,946 | B2 | 10/2008 | Huibers | |
| 7,438,443 | B2 | 10/2008 | Tatsuno et al. | |
| 7,476,016 | B2 | 1/2009 | Kurihara | |
| 7,520,642 | B2 | 4/2009 | Holman et al. | |
| 7,530,708 | B2 | 5/2009 | Park | |
| 7,537,347 | B2 | 5/2009 | Dewald | |
| 7,540,616 | B2 | 6/2009 | Conner | |
| 7,556,406 | B2 | 7/2009 | Petroski et al. | |
| 7,598,686 | B2 | 10/2009 | Lys et al. | |
| 7,605,971 | B2 | 10/2009 | Ishii et al. | |
| 7,626,755 | B2 | 12/2009 | Furuya et al. | |
| 7,677,736 | B2 | 3/2010 | Kasazumi et al. | |
| 7,684,007 | B2 | 3/2010 | Hull et al. | |
| 7,703,943 | B2 | 4/2010 | Li et al. | |
| 7,705,810 | B2 | 4/2010 | Choi et al. | |
| 7,709,811 | B2 | 5/2010 | Conner | |
| 7,719,766 | B2 | 5/2010 | Grasser et al. | |
| 7,728,846 | B2 | 6/2010 | Higgins et al. | |
| 7,766,490 | B2 | 8/2010 | Harbers et al. | |
| 7,819,556 | B2 | 10/2010 | Heffington et al. | |
| 7,828,453 | B2 | 11/2010 | Tran et al. | |
| 7,828,465 | B2 | 11/2010 | Roberge et al. | |
| 7,832,878 | B2 | 11/2010 | Brukilacchio et al. | |
| 7,834,867 | B2 | 11/2010 | Sprague et al. | |
| 7,835,056 | B2 | 11/2010 | Doucet et al. | |
| 7,841,714 | B2 | 11/2010 | Gruber | |
| 7,845,823 | B2 | 12/2010 | Mueller et al. | |
| 7,889,430 | B2 | 2/2011 | El-Ghoroury et al. | |
| 7,928,565 | B2 | 4/2011 | Brunschwiler et al. | |
| 7,959,338 | B2 * | 6/2011 | Kazakevich | 362/574 |
| 7,976,205 | B2 | 7/2011 | Grotsch et al. | |
| 8,016,443 | B2 | 9/2011 | Falicoff et al. | |
| 8,096,668 | B2 * | 1/2012 | Abu-Ageel | 362/84 |
| 2003/0039036 | A1 | 2/2003 | Kruschwitz et al. | |
| 2004/0052076 | A1 | 3/2004 | Mueller et al. | |
| 2004/0218390 | A1 | 11/2004 | Holman et al. | |
| 2005/0174768 | A1 | 8/2005 | Conner | |
| 2005/0190430 | A1 | 9/2005 | Patel et al. | |
| 2006/0002101 | A1 | 1/2006 | Wheatley et al. | |
| 2006/0002108 | A1 | 1/2006 | Ouderkirk et al. | |
| 2006/0002110 | A1 | 1/2006 | Dowling et al. | |
| 2006/0164005 | A1 | 7/2006 | Sun | |
| 2006/0164607 | A1 | 7/2006 | Morejon et al. | |
| 2006/0285078 | A1 | 12/2006 | Kasazumi et al. | |
| 2006/0285193 | A1 | 12/2006 | Kimura et al. | |
| 2006/0291269 | A1 | 12/2006 | Doucet et al. | |
| 2007/0013871 | A1 | 1/2007 | Marshall et al. | |
| 2007/0146639 | A1 | 6/2007 | Conner | |
| 2007/0159492 | A1 | 7/2007 | Lo et al. | |
| 2007/0188847 | A1 | 8/2007 | McDonald et al. | |
| 2007/0211449 | A1 | 9/2007 | Holman et al. | |
| 2007/0241340 | A1 | 10/2007 | Pan | |
| 2007/0263298 | A1 | 11/2007 | El-Ghoroury et al. | |
| 2007/0273794 | A1 | 11/2007 | Sprague et al. | |
| 2008/0062644 | A1 | 3/2008 | Petroski | |
| 2008/0143970 | A1 | 6/2008 | Harbers et al. | |
| 2008/0143973 | A1 | 6/2008 | Wu | |
| 2008/0198572 | A1 | 8/2008 | Medendorp | |
| 2008/0218992 | A1 | 9/2008 | Li | |
| 2008/0232084 | A1 | 9/2008 | Kon | |
| 2008/0285271 | A1 | 11/2008 | Roberge et al. | |
| 2009/0046307 | A1 | 2/2009 | Kwak et al. | |
| 2009/0059099 | A1 | 3/2009 | Linkov et al. | |
| 2009/0059585 | A1 | 3/2009 | Chen et al. | |
| 2009/0128781 | A1 | 5/2009 | Li | |
| 2009/0129079 | A1 | 5/2009 | Grotsch et al. | |
| 2009/0232683 | A1 | 9/2009 | Hirata et al. | |
| 2009/0262516 | A1 | 10/2009 | Li | |
| 2009/0273918 | A1 | 11/2009 | Falicoff et al. | |
| 2010/0006762 | A1 | 1/2010 | Yoshida et al. | |
| 2010/0046234 | A1 | 2/2010 | Abu-Ageel | |
| 2010/0061068 | A1 | 3/2010 | Geissler et al. | |
| 2010/0061078 | A1 | 3/2010 | Kim | |
| 2010/0103389 | A1 | 4/2010 | McVea et al. | |
| 2010/0110516 | A1 | 5/2010 | Penn et al. | |
| 2010/0128233 | A1 | 5/2010 | Liu et al. | |
| 2010/0165599 | A1 | 7/2010 | Allen | |
| 2010/0202129 | A1 | 8/2010 | Abu-Ageel | |
| 2010/0231863 | A1 | 9/2010 | Hikmet et al. | |
| 2010/0232134 | A1 | 9/2010 | Tran | |
| 2010/0244700 | A1 | 9/2010 | Chong et al. | |
| 2010/0302464 | A1 | 12/2010 | Raring et al. | |
| 2010/0315320 | A1 | 12/2010 | Yoshida | |
| 2010/0320928 | A1 | 12/2010 | Kaihotsu et al. | |
| 2010/0321641 | A1 | 12/2010 | Van Der Lubbe | |
| 2010/0321933 | A1 | 12/2010 | Hatanaka et al. | |

OTHER PUBLICATIONS

Arthur P. Fraas, Heat Exchanger Design, 1989, p. 60, John Wiley & Sons, Inc., Canada.

J. Y. San, C. H. Huang. M. H. Shu, "Impongement cooling of a confined circular air jet", Int. J. Heat Mass Transf., 1997, pp. 1355-1364, vol. 40.

H. A. El-Shaikh, S. V. Garimella, "Enhancement of Air Het Impingement Heat Transfer using Pin-Fin Heat Sinks", IEEE Transactions on Components and Packaging Technology, Jun. 2000, vol. 23, No. 2.

Yongmann M. Chung, Kai H. Luo, "Unsteady Heat Transfer Analysis of an Impinging Jet", Journal of Heat Transfer—Transactions of the ASME. Dec. 2002, pp. 1039-1048, vol. 124, No. 6.

S. A. Solovitz, L. D. Stevanovic, R. A. Beaupre, "Microchannets Take Heatsinks to the Next Level", Power Electronics Technology, Nov. 2006.

Tannith Cattermole, "Smart Energy Glass controls light on demand", Gizmag.com, Apr. 18, 2010, accessed Nov. 1, 2011.

* cited by examiner

REMOTE LIGHT WAVELENGTH CONVERSION DEVICE AND ASSOCIATED METHODS

FIELD OF THE INVENTION

The present invention relates to the field of light conversion devices and, more specifically, to including a color conversion material with a waveguide to remotely convert light and illuminate a space, and associated methods.

BACKGROUND OF THE INVENTION

Lighting devices that include a conversion material may conveniently allow the conversion of a source light emitted from a light source into light of a different wavelength range. Often, such a conversion may be performed by using a luminescent, fluorescent, or phosphorescent material. The wavelength conversion materials may sometimes be included in the bulk of another material, applied to a lens or optic, or otherwise located in line with the light emitted from light source. In some instances the conversion material may be applied to the light source itself. A number of disclosed inventions exist that describe lighting devices that utilize a conversion material applied to an LED to convert light with a source wavelength range into light with a converted wavelength range.

However, LEDs and other lighting elements may generate heat during operation. Applying a conversion material directly upon a lighting element for light source) may cause the coating to be exposed to an excessive amount of heat, resulting in decreased operational efficiency of the conversion material, and possible breakdown of the material.

Current remote color conversion technologies may place the color conversion materials in relatively close proximity to the LED light sources. The conversion materials may be in intimate physical contact with the LED or may be included in the optical system. However, physical integration of the conversion material and the light source may prohibit the ability to adjust the composition of the emitted light, except through the use of filters that may inefficiently absorb the emitted light.

In the past, proposed solutions have attempted to isolate the conversion material from the heat generated by the lighting element by locating the conversion coating on an enclosure. After light is emitted from the lighting element, it may then pass through the conversion coated enclosure prior to illuminating a space. However, coating the entire surface of the enclosure may require copious amounts of conversion coating materials, increasing the production cost of a lighting device employing this method.

Alternatively, previously proposed solutions have disclosed applying a conversion material to a lens, through which the light emitted from a light source may pass. Less conversion material may be required to coat the surface area of the lens, as opposed to the interior of an enclosure. However, the lens may need to be large to allow light to pass with a sufficiently wide projection angle, thereby requiring a large surface area. Although applying a conversion coating to a lens may be an improvement over applying the coating to an entire enclosure, the lens-based proposed solution is still not optimal.

There exists a need for a remote light wavelength conversion device that allows for source light emitted in one wavelength range to be transmitted to a remote location, and convert the source light into a converted light within a converted wavelength range at or before the remote location to illuminate a space. There further exists a need for a remote light wavelength conversion device that performs the wavelength conversion operation away from a heat generating light source with a minimal conversion area.

SUMMARY OF THE INVENTION

With the foregoing in mind, embodiments of the present invention are related to a remote light wavelength conversion device that receives a source light emitted from a light source in one wavelength range, transmit the source light to a remote location, and converts the source light into a converted light within a converted wavelength range to illuminate a space at or before the remote location. The remote light wavelength conversion device of an embodiment of the present invention may also advantageously perform the wavelength conversion operation away from a heat generating light source, with a minimal conversion area. By providing a remote light wavelength conversion device that advantageously converts light at a remote location, away from the heat generating light source, the remote wavelength conversion device according to an embodiment of the present invention may beneficially possess characteristics of reduced complexity, size, and manufacturing expense.

These and other objects, features, and advantages according to embodiments of the present invention are provided by a remote light wavelength conversion device for converting a source light into a converted light. The source light may be emitted from a light source within a source wavelength range. Additionally, the converted light may be within a converted wavelength range.

The remote wavelength conversion device may include a waveguide, which may be defined by a first end and a second end opposite the first end. Additionally, the remote wavelength conversion device may include a color conversion optic. The color conversion optic may convert the source light transmitted through the waveguide to the converted light to be directed from the second end. Also, the source light may be transmitted from the first end of the waveguide to the second end of the waveguide.

In an embodiment of the remote wavelength conversion device of the present invention, the waveguide may be an optical fiber. More specifically, the optical fiber may be a single mode fiber. Additionally, the color conversion optic may include a conversion material within the bulk of the optic, or applied as a coating to the optic. The color conversion optic may be located adjacent to the second end of the waveguide. The conversion material may include one or more of a luminescent, fluorescent, or phosphorescent material. A person of skill in the art will appreciate a luminescent material to include phosphors and/or quantum dots.

The color conversion optic may include a plurality of interchangeable color conversion optics, which may correspond to a desired output color or chromaticity. Also, the plurality of interchangeable color conversion optics may be selectable to convert the source light into the converted light with the desired output color or chromaticity, which may be defined by the converted wavelength range. In an embodiment of the remote wavelength conversion device of the present invention, the converted wavelength range may affect melatonin production.

The remote wavelength conversion device, according to an embodiment of the present invention, may include a light source to produce a source light. The light source may, for example, be a light emitting diode. The source light may be monochromatic and may be within a source wavelength range of 200 and 500 nanometers. In another embodiment of the present invention, the source light may be bichromatic or polychromatic. In an additional embodiment of the present invention, the source light may be within a source wavelength of 500 and 650 nanometers.

In an embodiment of the remote wavelength conversion device of the present invention, the waveguide may be included in an array of waveguides. Each waveguide in the array of waveguides may be selectively enabled by a controller. In an additional embodiment of the remote wavelength conversion device of the present invention, optical fixtures may be located adjacent to the second end of the waveguide to provide a light distribution pattern.

A method aspect, according to an embodiment of the present invention, is for using the remote light wavelength conversion device. The method may include receiving the source light emitted from the light source within the source wavelength range. The source light may be received at the first and of the waveguide. The method may additionally include transmitting the source light from the first end of the waveguide to the second and of the waveguide. Furthermore, the method may include converting the source light within the source wavelength range into the converted light within a converted wavelength range. The conversion may be performed via a color conversion optic adjacently.

BRIEF DESCRIPTION OF THE DRAWING

FIGS. 6A and 68 are cross sectional views showing embodiments of the wavelength conversion device illustrated in FIG. 6.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of embodiments of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the embodiments of the present invention.

Referring now to FIGS. 1-12, a remote light wavelength conversion device 10, according to an embodiment of the present invention is now described in greater detail. Throughout this disclosure, the remote light wavelength conversion device 10 may also be referred to as a remote conversion device, conversion device, device, embodiment, or the invention. Alternate references of the remote light wavelength conversion device 10 in this disclosure are not meant to be limiting in any way. A person of skill in the art, after having the benefit of this disclosure, will appreciate that the present invention may include embodiments that perform total, partial, and minimal conversion of a source light 42 into a converted light 46. Additionally, skilled artisans will appreciate that, in embodiments with partial wavelength conversions, the remaining, unconverted source light 42 may be combined with the converted light 46 to be directed in the desired output direction.

Figure 1:
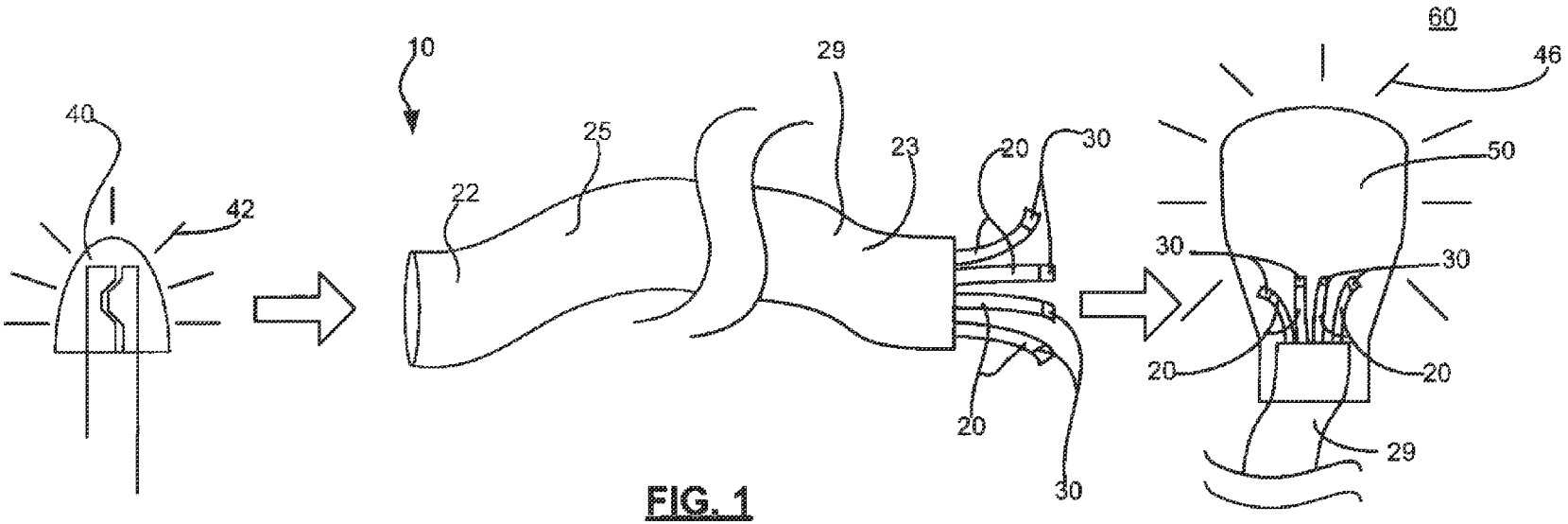
FIG. 1 is a partial schematic view of a remote light wavelength conversion device according to an embodiment of the present invention.
Figure 2:
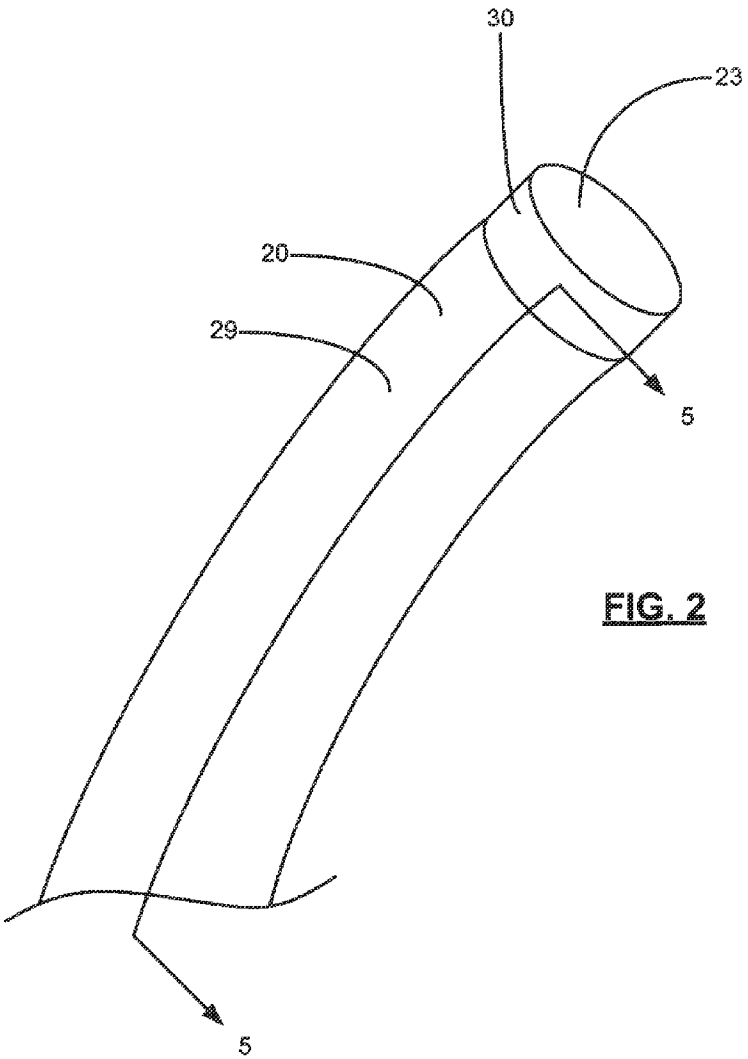
FIG. 2 is a partial view of a waveguide of the remote light wavelength conversion device illustrated in FIG. 1.

As perhaps best illustrated in FIG. 1, the remote conversion device 10 according to an embodiment of the present invention includes a device that uses a waveguide 20 to transmit a source light 42 to a remote location. A plurality of waveguides 20 may comprise a waveguide cluster 29, which may be included in a sheath 25. The source light 42 may be converted into a converted light 46 via a color conversion optic 30 at the remote location. In an embodiment of the present invention, the converted light 46 may be emitted by the waveguide 20 within a fixture 50 to illuminate an interior volume of the fixture 50. The fixture 50 may, in turn, reflect the converted light 46 to illuminate a space 60, such as a room. A color conversion optic 30, which may include a conversion material incorporated within the bulk material of the optic, or applied as a coating to the optic, may be located adjacent to a second end 23 of the waveguide 20 to convert the source light 42 into the converted light 46, as will be described in greater detail below, and as perhaps best illustrated in FIGS. 2-6 and 9.

Additionally, the color conversion optic 30 may be included in the bulk of the material between the first end 22 and second end of the waveguide 20.

As illustrated in FIG. 1, for example, the waveguide 20 may receive the source light 42 at its first end 22. The source light 42 may originate from a light source 40. The light source 40 may, for example, include light emitting diodes (LEDs) capable of emitting light in a source wavelength range. Other embodiments of the present invention may include source light 42 that is generated by a laser based light source 40. Those skilled in the art will appreciate that the source light 42 may be provided by any number of lighting devices, which may include, but should not be limited to, additional light emitting semiconductors.

The source wavelength range may include a source light 42 emitted in blue or ultraviolet wavelength ranges. However, a person of skill in the art, after having the benefit of this disclosure, will appreciate that LEDs capable of emitting light in any number of wavelength ranges may be used in the light source 40. A skilled artisan will also appreciate, after having the benefit of this disclosure, additional light generating devices that may be used as the light source 40 which are capable of creating an illumination.

As previously discussed, embodiments of the present invention may include a light source 40 that generates source light 42 with a source wavelength range in the blue spectrum. The blue spectrum may include light with a wavelength range between about 400 and 500 nanometers. A source light 42 in the blue spectrum may be generated by a light emitting semiconductor that is comprised of materials that may emit a light in the blue spectrum. Examples of such light emitting semiconductor materials may include, but are not intended to be limited to, zinc selenide (ZnSe) or indium gallium nitride (InGaN). These semiconductor materials may be grown or formed on substrates, which may be comprised of materials such as sapphire, silicon carbide (SiC), or silicon (Si). Additionally, an embodiment of the light source 40 may include a light emitting semiconductor that is removed from the substrate. In this embodiment, the light emitting semiconductor may optionally be bonded to another surface or material. A person of skill in the art will appreciate that, although the preceding semiconductor materials have been disclosed herein, any semiconductor device capable of emitting a light in the blue spectrum is intended to be included within the scope of the described embodiments of the present invention.

Additionally, as previously discussed, embodiments of the present invention may include a light source 40 that generates source light 42 with a source wavelength range in the ultraviolet spectrum. The ultraviolet spectrum may include light with a wavelength range between about 200 and 400 nanometers. A source light 42 in the ultraviolet spectrum may be generated by a light emitting semiconductor that is comprised of materials that may emit a light in the ultraviolet spectrum. Examples of such light emitting semiconductor materials may include, but are not intended to be limited to, diamond (C), boron nitride (BN), aluminum nitride (AlN), aluminum gallium nitride (AlGaN), or aluminum gallium indium nitride (AlGaInN). These semiconductor materials may be grown or formed on substrates, which may be comprised of materials such as sapphire, silicon carbide (SiC), or Silicon (Si). Additionally, an embodiment of the light source 40 may include a light emitting semiconductor that is removed from the substrate. In this embodiment, the light emitting semiconductor may optionally be bonded to another surface or material. A person of skill in the art will appreciate that, although the preceding semiconductor materials have been disclosed herein, any semiconductor device capable of emitting a light in the ultraviolet spectrum is intended to be included within the scope of the described embodiments of the present invention.

The light source 40, according to an embodiment of the present invention, may include an organic light emitting diode (OLED). OLED may be a comprised of an organic material that may emit light when an electric current is applied. The organic material may be positioned between two electrodes. Typically, at least one of the electrodes may be transparent.

In an additional embodiment of remote conversion device 10 of the present invention, the light source 40 may include an electroluminescent material. An electroluminescent material may be included within the definition of a light emitting semiconductor. A light source 40 including electroluminescent materials may be comprised of organic and/or inorganic materials. Skilled artisans will appreciate that light may be emitted as a result of an electric voltage, generated from a direct current (DC) or alternating current (AC) source, being applied across the electroluminescent material. In an embodiment of the light source 40 including an electroluminescent material, the electric voltage may cause the electrons to enter an excited state through impact ionization, which will be appreciated by skilled artisans. Light may then be emitted as the energy of the electrons decay back to the ground state. Additional embodiments of the light source 40, which include an electroluminescent material, will be apparent to a person of skill in the art, and are intended to be included within the scope of remote conversion device 10 disclosed herein.

The source light 42 may be converted by the color conversion optic 30 into a converted light 46 with an organic wavelength range, or wavelength range that triggers psychological cues within the human brain. This wavelength range may include a selective portion of the source light 42. These organic wavelength ranges may include one or more wavelength ranges that trigger positive psychological responses. As a result, the brain may affect the production of neurological chemicals, such as, for example, by inducing or suppressing the production of melatonin. The psychological responses may be similar to those realized in response to natural light or sunlight.

A person of skill in the art will appreciate that the remote conversion device 10, according to an embodiment of the present invention, may receive a source light 42 that is monochromatic, bichromatic, or polychromatic. A monochromatic light is a light that may include one wavelength range. A bichromatic light is a light that includes two wavelength ranges that may be derived from one or two light sources 40. A polychromatic light is a light that may include a plurality of wavelength ranges, which may be derived from one or more light sources 40. Preferably, the remote conversion device 10, according to an embodiment of the present invention, may include a monochromatic light, but a person of skill in the art will appreciate bichromatic and polychromatic light sources 40 to be included within the scope and spirit of embodiments of the present invention.

Continuing to reference FIGS. 1-6, additional features of the remote conversion device 10, according to an embodiment of the present invention, will now be discussed in greater detail. More specifically, the waveguide 20 will now be discussed. A waveguide 20 is an object that may be located between the light source 40 and the space 60 to be illuminated by the remote conversion device 10, according to an embodiment of the present invention. The name reflects the nature of a waveguide 20, since it may guide a wave, such as a light wave. The waveguide 20 may include a first end 22 that receives the source light 42 emitted by the light source 40. The waveguide 20 may also include a second end 23 to emit the source light 42 transmitted through the waveguide 20. The source light 42 transmitted to the second end 23 may subsequently be converted into a converted light 46 at the second end. The converted light 46 may then be emitted to illuminate a space 60, such as, for example, a room.

The first end 22 of the waveguide 20 may be positioned adjacent to the light source 40. As a result, the first end 22 of the waveguide 20 may receive the source light 42 emitted by the light source 40. The waveguide 20 may additionally transmit the source light 42 emitted from the light source 40 received at its first end 22 to its second end 23. The second end 23 of the waveguide 20 may be positioned to face the desired direction in which converted light 46 may be emitted to illuminate a space 60, i.e., an output direction.

The second end 22 of the waveguide 20 may include a color conversion optic 30. The color conversion optic 30 may include a luminescent, fluorescent, and/or phosphorescent material within the bulk of the material comprising the optic. Alternatively, the color conversion optic 30 may include a conversion coating applied to the optic. The conversion material, whether included in, or applied to, the color conversion optic 30, may convert the wavelength range of the source light 42 transmitted through the waveguide 20 into a converted light 46. The converted light 46 may then be used to illuminate the space 60. In an additional embodiment of the present invention, the color conversion optic 30 may be a conversion coating applied directly to the second end 23 of the waveguide 20. The color conversion optic 30 will be discussed in greater detail below. Accordingly, this use of the term color conversion optic 30 in this specification is meant to include a separate item that includes a conversion material that may be connected to the second end 23 of the waveguide 20, or may be provided by the conversion material applied directly to the second end of the waveguide.

The waveguide 20 may be a flexible and wave-conductive length of material bordered by its first end 22 and second end 23. The waveguide 20 may be configured with a diameter that may transmit a wave, such as a light wave, from its first end 22 to its second end 23. Preferably, the diameter of the waveguide 20 may be sufficiently small enough to provide flexibility of the waveguide 20. However, a person of skill in the art will appreciate that the waveguide 20 may have any diameter suitable to transmit a wave, such as a light wave, from a source location to a remote location.

The waveguide 20 may be constructed from a plethora of materials possessing a low refractive index, such as, but not limited to, silica, glass, or plastic materials. The waveguide 20 may additionally be configured to reflect the received source light 42 within the interior of the waveguide 20 until it may be emitted at the second end 23.

As will be appreciated by a person of skill in the art, a waveguide 20 used to transmit source light 42 from a source location to a remote location may be an optical fiber. Skilled artisans will also appreciate that the use of an optical fiber, as included within this disclosure, should not be viewed as limiting the waveguide 20 of the remote conversion device 10 of the described embodiments of the present invention in any way. Therefore, the use of optical fiber in this specification to describe a specific embodiment of the waveguide 20 is used for clarity, and without any intended limitation.

Figure 5:
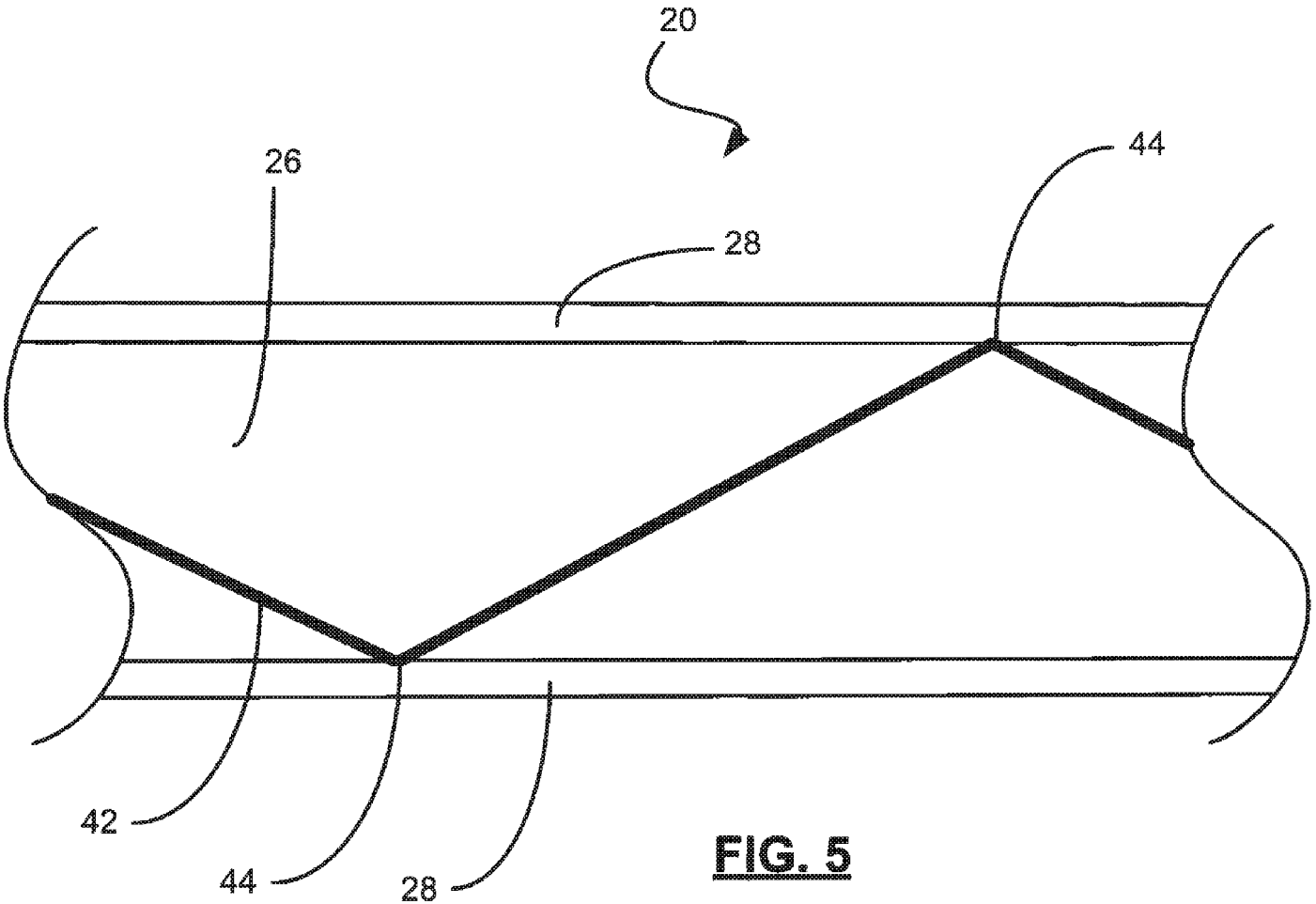
FIG. 5 is a cross sectional view of a waveguide of the remote light wavelength conversion device taken through line 5-5 in FIG. 2.

Referring now to FIG. 5, a waveguide 20, and more specifically, an optical fiber according to an embodiment of the present invention will now be discussed. Optical fibers may include a cylindrical waveguide core 26 to transmit light. The core 26 may be defined by an index of refraction relative to the materials used to form the core 26. The core 26 may be surrounded by a cladding layer 28. The cladding layer 28 may also be defined by an index of refraction relative to the materials used to form the cladding layer 28. To transmit light through the core 26 of the optical fiber, it is preferably that the index of refraction for the core 26 be greater than the index of refraction for the cladding layer 28.

As the light may travel through the core 26 of the optical fiber, it may encounter a boundary 44. The boundary 44 may be defined as the point at which the core 26 meets the cladding layer 28 of the optical fiber, i.e., an interior wall of the cladding layer, with respect to the core. Light that may encounter the boundary 44 at an angle larger than a critical angle of the light, as it may be defined by its wavelength range, resulting in the light being substantially internally reflected. As the light continues to travel through the optical fiber, it may continue to be internally reflected as it may subsequently, and repeatedly, encounter the boundary 44 of the optical fiber. This continual reflection may repeat until the light may be emitted from the second end 23 of the optical fiber. This repeated reflection may be known to those skilled in the art as total internal reflection. By reflecting a wavelength range of light through an optical fiber, the remote conversion device 10, according to an embodiment of the present invention, may virtually eliminate losses caused by electromagnetic radiation and advantageously transmit light with very high efficiency.

To achieve total internal reflection, it is preferably that the light be received by the optical fiber at an angle that may allow the reflection to occur. This angle in which the light may be accepted by the waveguide to achieve total internal reflection may be known in the art as the acceptance angle.

For illustrative purposes, optical fibers with a core diameter of greater than approximately ten micrometers may be used to transmit a wide wavelength range, which may include the wavelength range of white light. This wide core optical fiber may be known in the art as a multi mode fiber. However, to provide for a wide wavelength range of light that may be transmitted via the optical fiber, a multi mode fiber may require efficiency compromises to accommodate the wide wavelength range. These compromises may result in leaked light from the core 26 of the optical fiber which, in turn, may decrease the amount of light that may be emitted by the optical fiber at its second end. This decrease in light emission may become even more pronounced as the length of the optical fiber is increased.

Optical fibers with a core diameter of less than approximately ten micrometers may transmit a narrow wavelength range, which may include the wavelength range of a certain color of light. This narrow core optical fiber may be known in the art as a single mode fiber. Provided as a non-limiting example, the wavelength range transmitted in a single mode optical fiber may be the source wavelength range of a blue source light 42.

Since a single mode optical fiber does not have to accommodate for the wide wavelength range of white light, the single mode optical fiber may advantageously transmit a narrow wavelength range of light with low loss characteristics. Since the loss characteristics of the single mode optical fiber may be low, the distance which the light may be transmitted may be significantly greater than that of a multi mode optical fiber. However, as mentioned above, the single mode fiber may not transmit a wide wavelength range of light. This compromise of a narrow wavelength range of transmitted light may be moot, as a conversion material may be applied to the second end of the optical fiber, according to an embodiment of the present invention, or more generally, the waveguide 20, as discussed further below.

Figure 3:
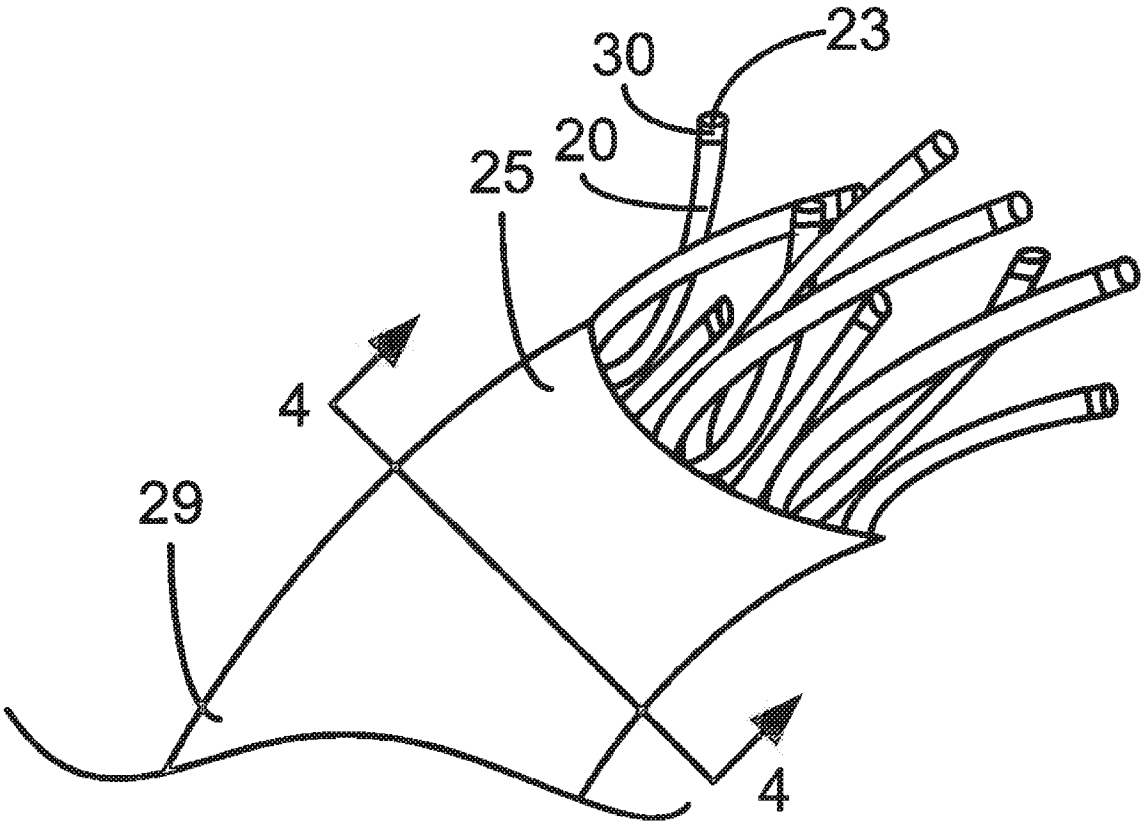
FIG. 3 is a partial side elevation view of a plurality of waveguides of the remote light wavelength conversion device illustrated in FIG. 1.
Figure 4:
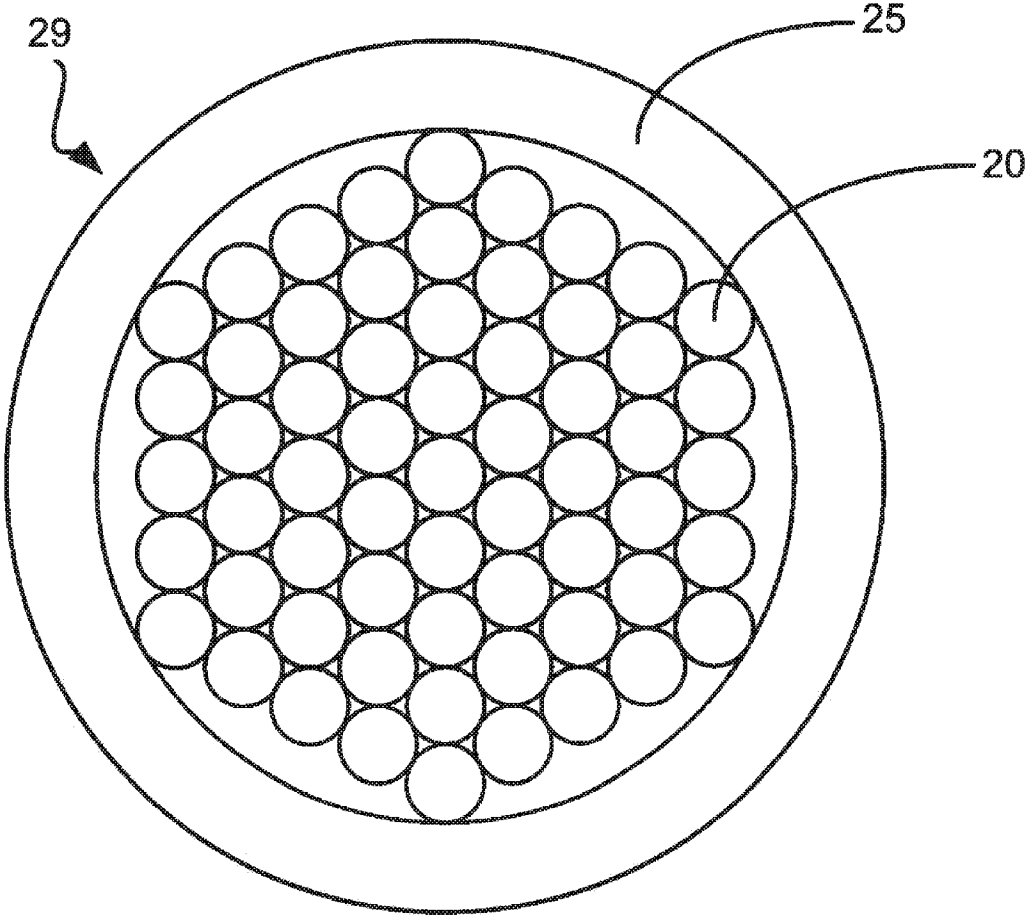
FIG. 4 is a cross sectional view of the remote light wavelength conversion device taken through line 4-4 in FIG. 3.

As perhaps best illustrated in FIGS. 3-4, a plurality of waveguides 20 may be proximately grouped together into a waveguide cluster 29. The waveguide cluster 29 may be enclosed within a sheath 25, which may allow the waveguides to remain substantially adjacent to one another within the duster. Those skilled in the art will appreciate that an increased amount of light may be transmitted through the plurality of waveguides 20 versus the capacity of a single waveguide 20. More specifically, presented as a non-limiting example, a plurality of single mode fibers may be grouped together into a waveguide duster 29 and enclosed within a sheath 25. A plurality of single mode fibers may be chosen due to their low loss characteristics, providing a wide bandwidth of light transmitted within a narrow wavelength range. The source light 42 transmitted via a plurality of single mode fibers may subsequently be converted into a converted light 46, with a wavelength range wider than the wavelength range of the transmitted source light 42, via a color conversion optic 30 attached at their second ends 23.

Referring now to FIGS. 1-4 and 6, the color conversion optic 30 will now be discussed in greater detail. The color conversion optic 30 may be included as an element of the wavelength conversion device 10, according to an embodiment of the present invention, and may be located at the second end 23 of the waveguide 20. The color conversion optic 30 may include a conversion material, which may alter the source wavelength range of the source light 42 transmitted through the waveguide 20 into a converted wavelength range of a converted light 46.

In this disclosure, the color conversion optic 30 may be described as a structural element that may be located adjacent to an end of the waveguide 20, preferably the second end 23 of the waveguide 20, and may be connected thereto. By applying the conversion material to a color conversion optic 30, the color of the converted light 46 may be altered by interchanging a color conversion optic 30 that may produce a converted light 46 in one converted wavelength range with another color conversion optic 30 that may produce a converted light 46 within a different converted wavelength range. Skilled artisans should appreciate an additional embodiment of the color conversion optic 30 to include the direct application of a conversion material to the second end 23 of the waveguide 20, effectively resulting in a conversion coated second end 23.

The color conversion optic 30 may preferably include a fluorescent, luminescent, or phosphorescent material capable of converting light with a source wavelength range into a light with one or more converted wavelength ranges. The material may be included in, or applied to, the color conversion optic 30. However, it will be appreciated by skilled artisans that any wavelength conversion material capable of converting a light from one wavelength range to another wavelength range may be included in the color conversion optic 30, and is intended to be included within the scope and spirit of embodiments of the present invention.

As mentioned above, a conversion material may be included within the bulk material of the color conversion optic 30, according to an embodiment of the present invention. In this embodiment, the conversion material may be suspended or incorporated in the bulk material that comprises the color conversion optic 30. The bulk material may include, but should not be limited to, glass or plastic. In a non-limiting example, wherein the conversion material is included in a plastic color conversion optic 30, the solid optic may be formed or molded from plastic in the liquid state. The conversion material may be infused into the liquid plastic prior the solidification of the plastic into a solid color conversion optic 30. A person of skill in the art will appreciate that, in the present non-limiting example, the conversion material may be infused into liquid plastic homogeneously, methodologically, sporadically, or randomly.

An additional embodiment of the color conversion optic 30 may include a conversion coating comprising a fluorescent or luminescent material, which may further include a phosphor material, and may alter the wavelength range of light that may be transmitted through the coating. A source wavelength range may be converted into one or more converted wavelength ranges. As discussed above, a source light 42 may include a monochromatic, bichromatic, or polychromatic light emitted by one or more light sources 40. For the sake of clarity, references to a source light 42, and its corresponding source wavelength range, should be understood to include the light emitted by the one or more light sources 40 that is received by the waveguide 20 of the lighting device 10. Correspondingly, a source wavelength range should be understood to be inclusive of the wavelength ranges included in monochromatic, bichromatic, and polychromatic source lights 42.

Additionally, a source light 42 with a source wavelength range may be converted by the conversion material, which may be applied to, or included in, the color conversion optic 30, into a converted light 46 with one or more converted wavelength ranges. The use of multiple phosphor and/or quantum dot elements may produce a light that includes multiple discrete or overlapping wavelength ranges. These wavelength ranges may be combined to produce the converted light 46. For further clarity in the foregoing description, references to a converted light 46, and its corresponding converted wavelength ranges, should be understood to include all wavelength ranges that may be produced as the source light 42 may pass through the conversion material.

Luminescence is the emission light without the requirement of being heated. This is contrary to incandescence, which requires the heating of a material, such as a filament through which a current may be passed, to result in illumination. Luminescence may be provided through multiple processes, including electroluminescence and photoluminescence. Electroluminescence may occur as a current is passed through an electronic substance, such as a light emitting diode or a laser diode. Photoluminescence may occur as light from a first wavelength range may be absorbed by a photoluminescent material to be emitted as light in a second wavelength range. Photoluminescent materials may include fluorescent materials and phosphorescent materials.

A fluorescent material may absorb light within a first wavelength range, the energy of which may be emitted as light within a second wavelength range. The absorption and emission operation will be described in greater detail below. A non-limiting example of a fluorescent material may include the coating on fluorescent light bulb. Fluorescent materials may include, but should not be limited to, phosphors and quantum dots.

Phosphorescent material involves the absorption and emission of light, similar to that of a fluorescent material, however with differing energy state transitions. These differing energy state transitions may result in a delay between the absorption of light in the first wavelength range and the emission of light in the second wavelength range. A non-limiting example of a device with a phosphorescent material may include glow-in-the-dark buttons on a remote controller. Phosphorescent materials may include, but should not be limited to, phosphors.

A phosphor substance may be illuminated when it is energized. Energizing of the phosphor may occur upon exposure to light, such as the source light 42 emitted from the light source 40, for example. The wavelength of light emitted by a phosphor may be dependent on the materials of the phosphor. Typically, phosphors may convert a source light 42 into a converted light 46 within a wide converted wavelength range, as will be understood by skilled artisans.

A quantum dot substance may also be illuminated when it is energized. Energizing of the quantum dot may occur upon exposure to light, such as the source light 42 emitted from the light source 40. Similar to a phosphor, the wavelength of light emitted by a quantum dot may be dependent on the materials of the quantum dot. Typically, quantum dots may convert a source light 42 into a converted light 46 within a narrow converted wavelength range, as will be understood by skilled artisans.

The conversion of a source wavelength range into a converted wavelength range may include a shift of wavelength ranges, which may be known to those skilled in the art as a Stokes shift. During a Stokes shift, a portion of the source wavelength range may be absorbed by a conversion material. The absorbed portion of source light 42 may include light within a selective wavelength range, such as, for example, a biologically affective wavelength range. This absorption may result in a decreased intensity of light within the source wavelength range.

The portion of the source wavelength range absorbed by the conversion material may include energy, causing the atoms or molecules of the conversion material to enter an excited state. The excited atoms or molecules may release some of the energy caused by the excited state as light. The light emitted by the conversion material may be defined by a lower energy state than the source light 42 that may have caused the excited state. The lower energy state may result in wavelength ranges of the converted light 46 to be defined by light with longer wavelengths. A person of skill in the art will appreciate additional wavelength conversions that may emit a light with shorter wavelength ranges to be included within the scope of the present invention, as may be defined via the anti-Stokes shift.

As will be understood by a person of skill in the art, the energy of the light absorbed by the color conversion optic 30, which may include a conversion material, may shift to an alternate energy of light emitted from the color conversion optic 30. Correspondingly, the wavelength range of the light absorbed by the conversion material may be scattered to an alternate wavelength range of light emitted from the conversion material. If a light absorbed by the conversion material undergoes significant scattering, the corresponding emitted light may be a low energy light within a wide wavelength range. Substantial scattering characteristics may be definitive of a wide production conversion coating. Conversely, if the light absorbed by the conversion material undergoes minimal scattering, the corresponding emitted light may be a low energy light within a narrow wavelength range. Minimal scattering characteristics may be definitive of a narrow production conversion material.

In an embodiment of the remote conversion device 10 according to the present invention, a plurality of color conversion optics 30 may be located adjacent to the second end 23 of the waveguide 20 to generate a desired output color or chromaticity. For example, a plurality of phosphors and/or quantum dots may be used that are capable of generating green, blue, and/or red converted light 46. When these conversion materials are applied to the second end 23 of the waveguide 20, the materials may produce a converted light 46 in the converted wavelength range of the corresponding color conversion optic 30.

A person of skill in the art will appreciate chromaticity to objectively relate to the color quality of a light, independent from the quantity of its luminance. Additionally, skilled artisans will appreciate that chromaticity may be determined by a plurality of factors, including hue and saturation. The chromaticity of a color may be further characterized by the purity of the color as taken together with its dominant and complimentary wavelength components.

In an additional embodiment of the remote conversion device 10 according to the present invention, one or more color conversion optic 30 may be located adjacent to the second end 23 of the waveguide 20 to generate a desired output color or chromaticity. In an additional embodiment of the present invention, the desired chromaticity may define a non-saturated color.

For example, and without limitation, a plurality of phosphors and/or quantum dots may be used that are capable of converting a high energy source light 42, which may include a high concentration of light in the ultraviolet to blue wavelength ranges, into a lower energy converted light 46, which may include a high concentration of light in the yellow to red wavelength ranges. When the converted light 46 is combined with the unconverted source light 42, white light may be formed. This white light may then be directed in the desired output direction.

For clarity, the following non-limiting example is provided wherein a single waveguide 20 may include a color conversion optic 30 at its second end 23 coated with a yellow conversion material. A person of skill in the art will appreciate that any number of waveguides 20 may be included within the wavelength conversion device 10, according to embodiments of the present invention, and the present example is provided without limiting the wavelength conversion device 10 to a single waveguide 20. The yellow conversion material may include a yellow zinc silicate phosphor material. The light source 40 may include a blue LED. The yellow zinc silicate conversion material may be evenly distributed on the surface, or in the bulk material, of the color conversion optic 30. This color conversion optic 30 may be located adjacent to the second end 23 of the waveguide 20. A uniform distribution of the conversion material may result in the uniform conversion of a blue source light 42 transmitted through waveguide 20 into yellow converted light 46, which may produce white light when combined with the unconverted source light 42.

The creation of white converted light 46 may be accomplished by combining the converted light 46 with the source light 42. The converted light 46 may be within a converted wavelength range, including a high intensity of light defined within the visible spectrum by long wavelengths, such as red light. The source light 42 may be within a source wavelength range, including a high intensity of light defined within the visible spectrum by short wavelengths, such as blue light. By combining the light defined by short and long wavelength ranges within the visible spectrum, such as blue and red light, respectively, a substantially white light may be produced. A person of skill in the art will appreciate that the application of a nonuniform conversion material to a color conversion optic is intended to be included within the scope and spirit of embodiments of the present invention.

The preceding example, depicting a red silicate color conversion optic 30 is not intended to be limiting in any way. Instead, the description for the preceding example has been provided for illustrative purposes. A skilled artisan will appreciate that any wavelength range and, therefore, any corresponding color, may be produced by a color conversion optic 30 applied to the second end 23 of a waveguide 20 and remain within the scope of embodiments of the present invention. Thus, the remote conversion device 10 discussed herein, is not intended to be limited by the preceding example.

Figure 6:
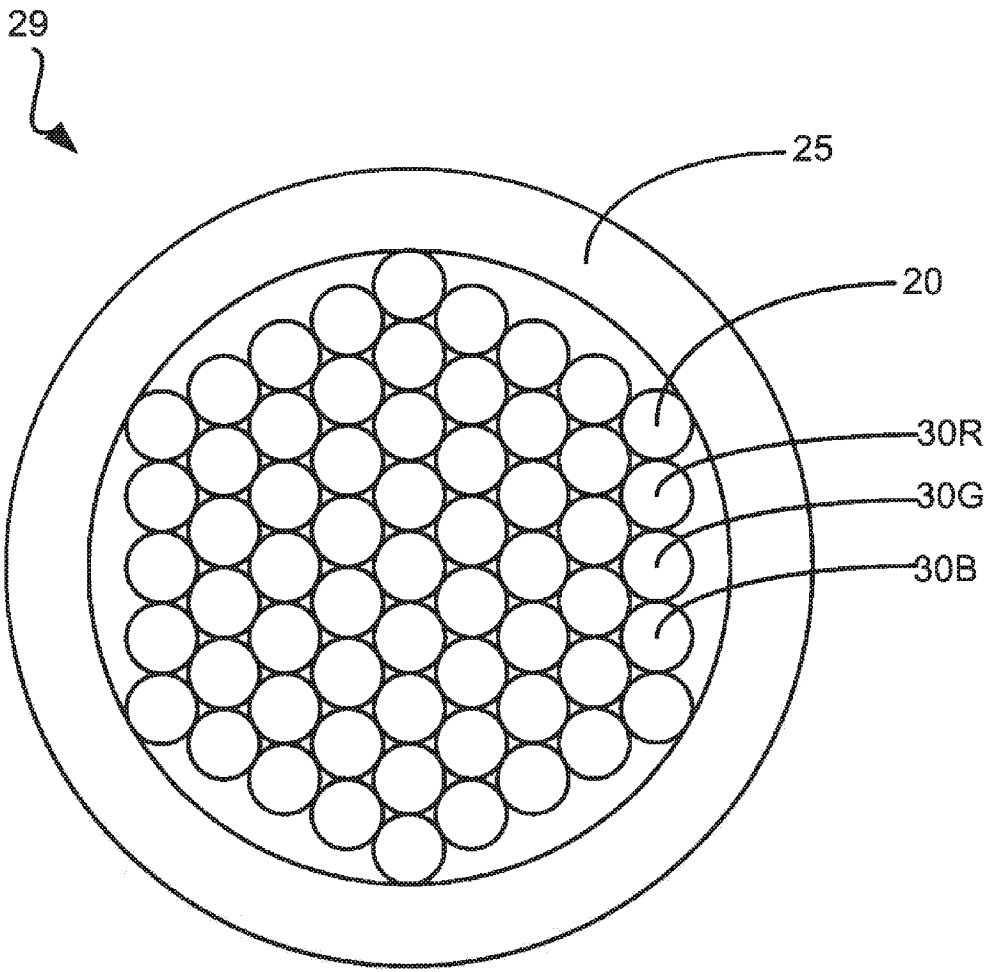
FIG. 6 is cross sectional view of the remote light wavelength conversion device illustrated in FIG. 4 and showing a plurality of color conversion optics.

Referring now additionally to FIG. 6, a non-limiting example will now be discussed that includes color conversion optics 30 to convert the source light 42 into converted light 46 of various colors. The color conversion optics 30G, 30R, and 30B are adjacently located to the second end of each of the waveguides 20 and may be evenly distributed. This even distribution may provide uniform emission of converted light 46, since the green color conversion optic 30G, blue color conversion optic 30B, and red color conversion optic 30R may occupy approximately the same proportionate ratio of the plurality of waveguides 20. A person of skill in the art will appreciate that a non-uniform distribution of green color conversion optics 30G, blue color conversion optics 30B, and red color conversion optics 30R are contemplated by embodiments of the present invention, as such a configuration may be demanded by the desired application of the remote conversion device 10.

A person of skill in the art, after having the benefit of this disclosure, will appreciate that color conversion optics 30, which may include conversion materials to produce light in a wavelength range other than green, blue, and red may be located adjacent to the second end 23 of a waveguide 20 and, therefore, would be included within the scope and spirit of embodiments of the present invention. A skilled artisan will additionally realize that any number of color conversion units 30, which may include conversion materials capable of producing converted light 46 of various converted wavelength ranges and corresponding colors, may be applied to the second end 23 of the waveguide 20 and still be included within the scope of this disclosure.

The preceding example, depicting three discrete color conversion optics 30, is not intended to be limiting in any way. Instead, the disclosure of the preceding example has been provided for illustrative purposes, solely as a non-limiting example. A skilled artisan will appreciate that any wavelength range and, therefore, any corresponding color, may be produced by a conversion material applied to a color conversion optic 30 located adjacent to the waveguide 20 to be included within the scope of embodiments of the present invention.

An additional embodiment of the remote conversion device 10 according to the present invention may receive a blue source light 42. More specifically, the plurality of waveguides 20 may include a number of waveguides 20 without a color conversion optic 30 located adjacent to the second end thereof. The lack of a color conversion optic 30 may allow the second end 23 of the respective waveguide 20 to emit the source light 42 as it is received by its first end 22. Additional desired colors may be provided by locating a color conversion optic 30 adjacent to the second end of the waveguide 20 that transmits the source light 42.

A person of skill in the art, after having the benefit of this disclosure, will appreciate that conversion materials, which may be applied to the color conversion units 30, or directly to the second end 23 of the waveguide 20, that may produce light in a wavelength range other than green, blue, and red are intended to be included within the scope and spirit of embodiments of the present invention. A skill artisan will additionally realize that any number of conversion materials, which may be capable of producing converted light 46 of various converted wavelength ranges and corresponding colors, may be applied to the color conversion optic 30 and/or the second end 23 of the waveguide 20 of the remote conversion device 10 of the remove wavelength conversion device 10 according to embodiments of the present invention.

Figure 6A:
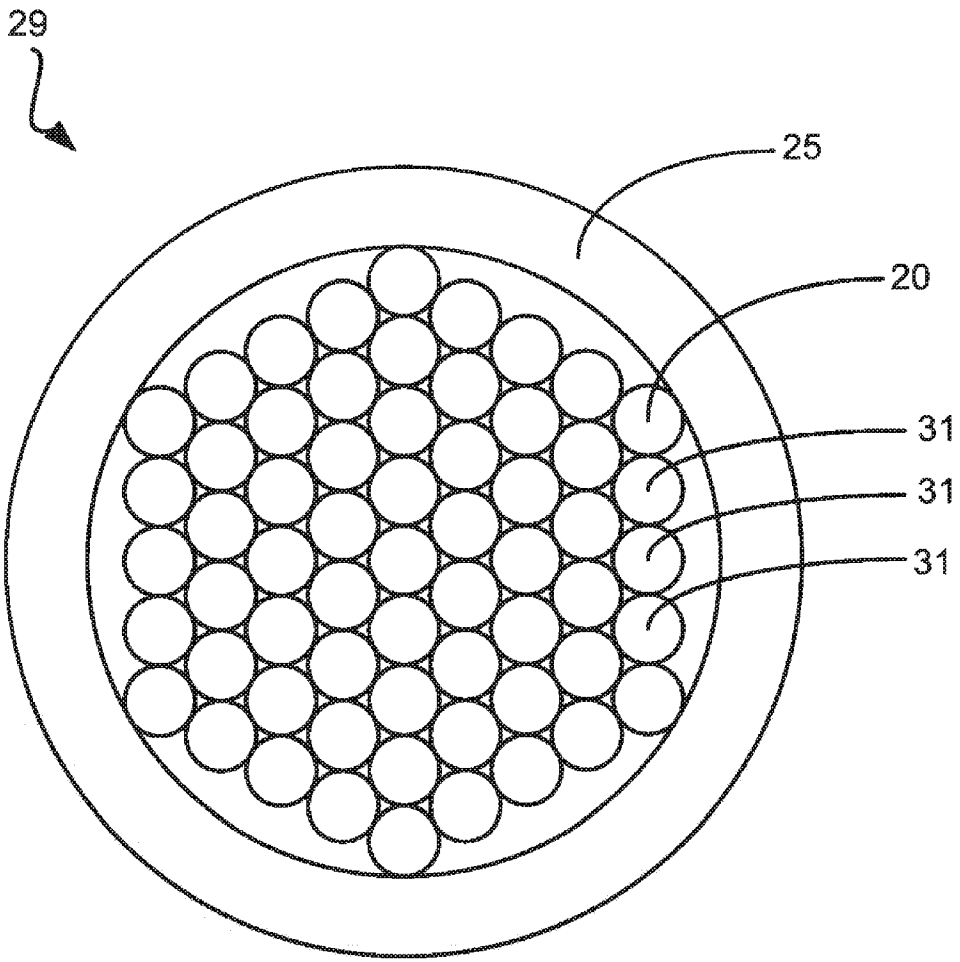

Referring now to FIG. 6A, an additional non-limiting example will now be discussed that includes color conversion optics 30 to convert the source light 42 into converted light 46. The converted light 46 may be combined with the source light 42 to create white light. The white light color conversion optic 31 may be located adjacent to, and may be evenly distributed at, the second end 23 of each waveguide 20. This even distribution may provide a uniform emission of white light, which may have been formed from the aforementioned combination of source light 42 and converted light 46.

Figure 6B:
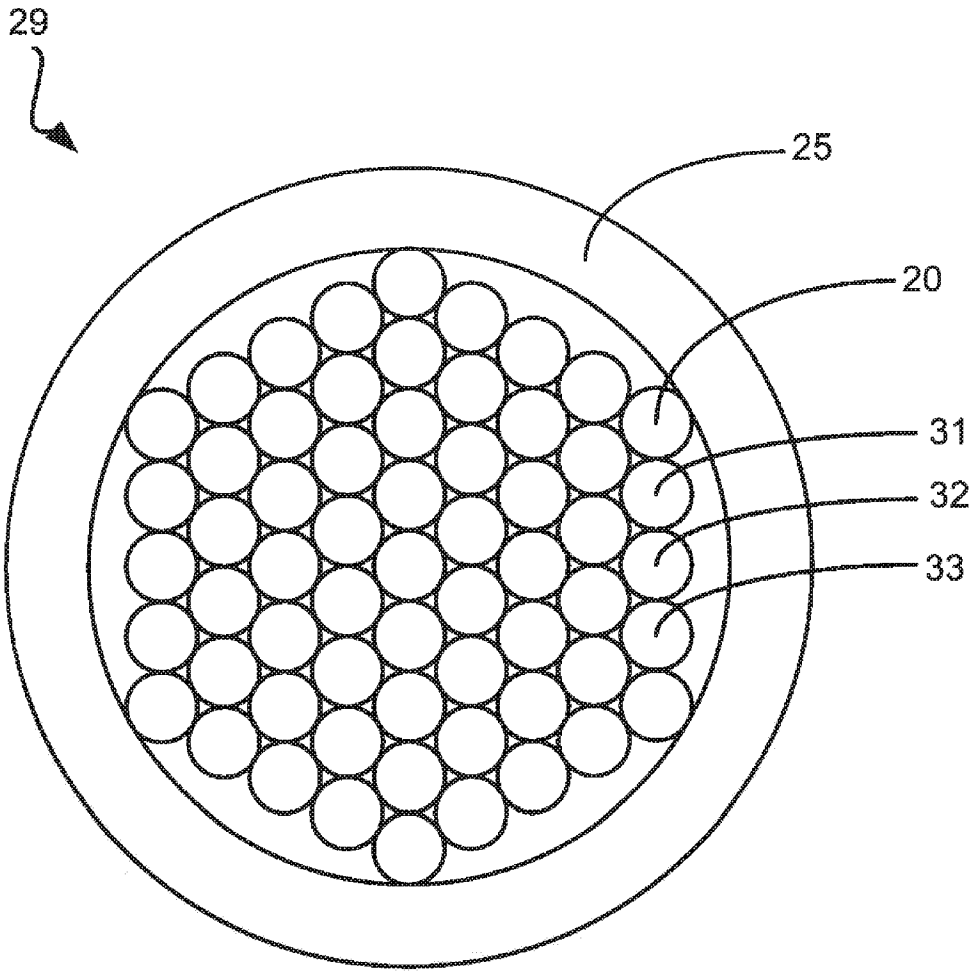

Referring additionally to FIG. 6B, a person of skill in the art will appreciate that a non-uniform distribution of color conversion optics 31, 32, 33, which may include varying levels of conversion material applied to the color conversion optics 31, 32, 33, are contemplated by embodiments of the present invention. Such configurations may be demanded by desired application of the remote conversion device 10. In this non-limiting example, the white color conversion optic 31 may perform substantially similarly to the above description, provided in association with FIG. 6A. The example shown in FIG. 6B may additionally include one or more warm white color conversion optic 32 and one or more cool white color conversion optic 33.

A person of skill in the art will appreciate that the present example may include any combination of white, warm white, and cool white color conversion optics 31, 32, 33, including combinations that may lack any of the aforementioned optics. For example, an embodiment may include one or more warm white color conversion optic 32 and cool white color conversion optic 33, but not a white light color conversion optic 31. The white color normally produced by the white light color conversion optic 31 may be substantially reproduced by emitting an approximately equal intensity of light using the warm white color conversion optic 32 and the cool white color conversion optic 33.

Additionally, the chromaticity of the white light may be controlled by varying the ratio of light converted by the warm white color conversion optic 32 and the cool white color conversion optic 33. As a specific non-limiting example, cool white light may be emitted by the remote conversion device 10 by converting a proportionally large amount of source light 42 into a converted light 46 using cool white color conversion optics 33. Correspondingly, a small proportional amount of source light 42 may be converted by the warm white color conversion optics 32 and/or the white light color conversion optics 31. The light directed from the color conversion optics 31, 32, 33 may be defined by the converted light 46 that has been converted by the largest proportion of color conversion optics 31, 32, 33. In the instant example, the larger proportion of cool white color conversion optics 33 may produce an apparently cool white light.

Referring back to FIGS. 1-3, additional features of the remote conversion device 10 according to an embodiment of the present invention are now described in greater detail. More specifically, the space 60 to be illuminated with the converted light 46 will now be discussed. After a source light 42 has been converted by the color conversion optic 36 into a converted light 46, it may be emitted to illuminate a space 60. As will be further discussed below, the converted light 46 may additionally be reflected by a fixture 50 before it may be directed in the space 60. The remote conversion device 10, according to an embodiment of the present invention, may emit the converted light 46 to be generally diffused into the space 60, such as a room or stage. The converted light 46 emitted by the remote conversion device 10 may thus illuminate the space 60.

The remote conversion device 10, according to an embodiment of the present invention, may additionally include a fixture 50, which may enclose or encompass at least part of the other elements of the remote conversion device 10. A person of skill in the art will appreciate that at least part of the other elements may additionally be located outside of the fixture 50. The fixture 50 may be constructed from a plethora of materials, such as, for example, a polycarbonate material.

The fixture 50 may be a structure of any shape or length which may partially or entirely enclose the second end 23 of the waveguide 20 included in the remote conversion device 10, according to an embodiment of the present invention. Presented as a non-limiting example, illustrative shapes may include, for example, cylindrical, conical, pyramidal, arcuate, round, rectangular, or any other shape.

Structurally, the fixture 50 may include walls to enclose a volume included therein. The was of the fixture 50 may be further defined by a top portion and a bottom portion. The fixture 50 may partially enclose the interior elements, or remain open to expose the interior elements to a space that may exist beyond the fixture 50. At least a part of the second end 23 of the waveguide 20 and the color conversion optic 30 may be carried by the fixture 50. In an embodiment of the present invention, the second end 23 of the waveguide 20 may be inserted into the fixture 50.

The inner surface of the fixture 50 may include a transparent or translucent material to transmit the light, which may include the converted light and any unconverted source light, in a direction to illuminate a space. The fixture may be configured in one or more shapes and/or patterns to provide a desired light distribution pattern. Light distribution patterns may include, for example, and without limitation, a flame for a candle shape (see FIG. 9), a desired angle, a graphic pattern, or other light distribution patterns that would be apparent to a person of skill in the art. An additional light distribution pattern may include lighting effects, such as, for example and without limitation, a flickering candle, blinking light, or fading engagement and disengagement of operation.

In an alternate configuration, the inner surface of the fixture 50 may be coated with a light reflective material, providing the desired light reflective qualities. As mentioned above, the walls of the fixture 50 may be partially or entirely transparent or translucent, allowing all, or a portion, of the light received by the walls to be transmitted through the fixture 50. A person of skill in the art will appreciate additional configurations of the fixture 50, after having the benefit of this disclosure, that are included within the scope and spirit of various embodiments of the present invention.

The remote conversion device 10, according to an embodiment of the present invention, may advantageously convert the wavelength range of a source light 42 and emit the converted light in one operation. More specifically, the remote conversion device 10, according to an embodiment of the present invention, may receive a source light 42 at the first end 22 of a waveguide 20, transmit the source light 42 to be emitted at the second end 23 of the waveguide 20, convert the source wavelength range of the source light 42 into a converted wavelength range of a converted light 46 using the color conversion optic 30, and direct the converted light 46 to illuminate a space 60.

An LED may emit light when an electrical current is passed through the diode in the forward bias. The LED may be driven by the electrons of the passing electrical current to provide an electroluminescence, or emission of light. The color of the emitted light may be determined by the materials used in the construction of the light emitting semiconductor. A laser diode is another type of a light emitting semiconductor that may emit a source light 42. A laser diode comprises a semiconductor doped to include a p-n junction, and may emit light as an electrical current is applied.

The foregoing description contemplates the use of semiconductors that may emit a light in the blue or ultraviolet wavelength range. However, a person of skill in the art will appreciate that light may be emitted by light emitting semiconductors of any wavelength range and remain within the breadth of the various embodiments of the present invention. Effectively, a light emitting semiconductor may emit a source light 42 in any wavelength range, since the emitted source light 42 may be subsequently converted by a color conversion optic 30 located adjacent to the second end 23 of the waveguide 20 prior to being directed to illuminate a space 60.

An example of the operation of the remote conversion device 10, according to an embodiment of the present invention, will now be discussed. A color conversion optic 30 may be located adjacent to the second end 23 of the waveguide 20. The color conversion optic 30 may include a conversion coating to convert a source wavelength range into a converted wavelength range. As an additional example, without limitation, the conversion coating 30 may be applied directly to the second end 23 of the waveguide 20 to receive and convert the source light 42 transmitted through by the waveguide 20. In an alternate example, the color conversion optic 30 may additionally be defined by the inclusion of a color conversion material in the bulk material of the waveguide 20, for example, at the second end 23. Inclusion of the conversion material at the second end 23 of the waveguide 20 may allow the source light 42 to be converted into a converted light 46 after it has been transmitted through the waveguide 20.

Figure 7:
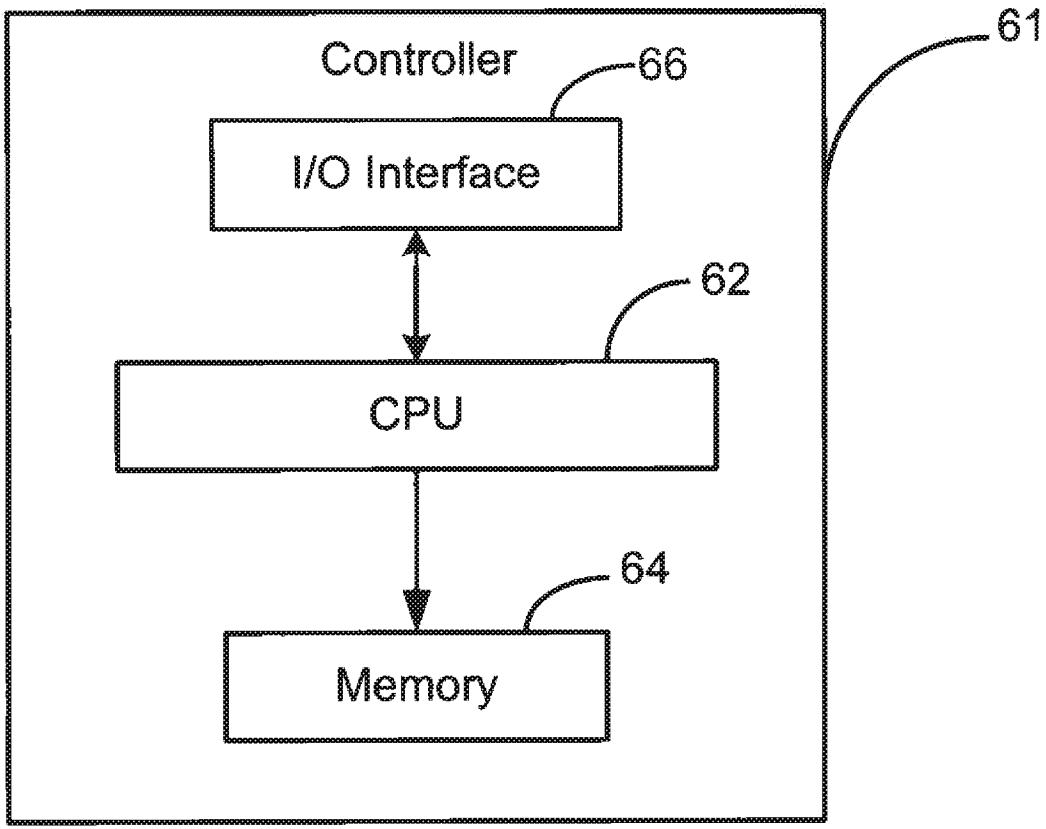
FIG. 7 is a schematic block diagram of a controller of the remote light wavelength conversion device according to an embodiment of the present invention.

Referring now to FIG. 7, an embodiment of the remote conversion device 10 of the present invention may include a controller 61 to selectively control the light transmitted through the waveguide 20. The controller 61 may include a CPU 62, memory 64, and an I/O interface 66. The CPU 62 may be configured to receive a data signal from additional components of the remote conversion device 10, for example without limitation, via the I/O interface 66.

The CPU 62 may compute and perform calculations to data received by the additional components. As a non-limiting example, the CPU 62 may receive a series of lighting routines inputted by a user. The CPU 62 may then analyze the lighting routines to determine which waveguides 20 to through which to transmit source light 42. The CPU 62 may additionally control the duty cycle of the source light 42 emitted by the light source 40, effectively controlling the brightness of the light.

The controller 61 may also include memory 64. The memory 64 may include volatile and non-volatile memory modules. Volatile memory modules may include random access memory, which may temporarily store data and code being accessed by the CPU 62. The non-volatile memory 64 may include flash based memory, which may store the computerized program that may be operated on the CPU 62.

Additionally, the memory 64 may include the computerized code used by the CPU 62 to control the operation of the remote conversion device 10. The memory 64 may also store feedback information related to the operation of additional components included in the remote conversion device 10. In an embodiment of the present invention, the memory 64 may include an operating system, which may additionally include applications that may be run within the operating system, which will be appreciated by a person of skill in the art The controller 61 may also include an I/O interface 66. The I/O interface 66 may control the receipt and transmission of data between the controller 81 and additional components. Provided as a non-limiting example, the I/O interface 66 may receive a lighting routine program from a user. After the CPU 62 has analyzed the lighting routine program, the I/O interface 66 may transmit a signal to control the illumination of a space by enabling or disabling select waveguides 20.

To select the source light to be transmitted through the waveguide, the remote conversion device 10 may include a MEMS device. The MEMS device may be further described in U.S. patent application Ser. No. 13/073,805 to Maxik, at al., the entire contents of which is incorporated herein by reference. In an embodiment of the present invention, the MEMS device may be included adjacent to the first end 22 of the waveguide 20. Such a MEMS device may selectively enable specific waveguides 20 to transmit a source light 42. The MEMS device may be communicatively connected to the controller 61, which may be used to selectively and dynamically enable or disable the micromirrors included in the MEMS device.

Alternately, the plurality of light sources 40 may be selectively enabled our disabled, resulting in the emission of source light 42 to be received by various groups of waveguides 20. Each group of waveguides 20 may include a color conversion optic 30 at its second end 23 to convert the source light 42 into a converted light 46 with a desired color and converted wavelength range.

Figure 8:
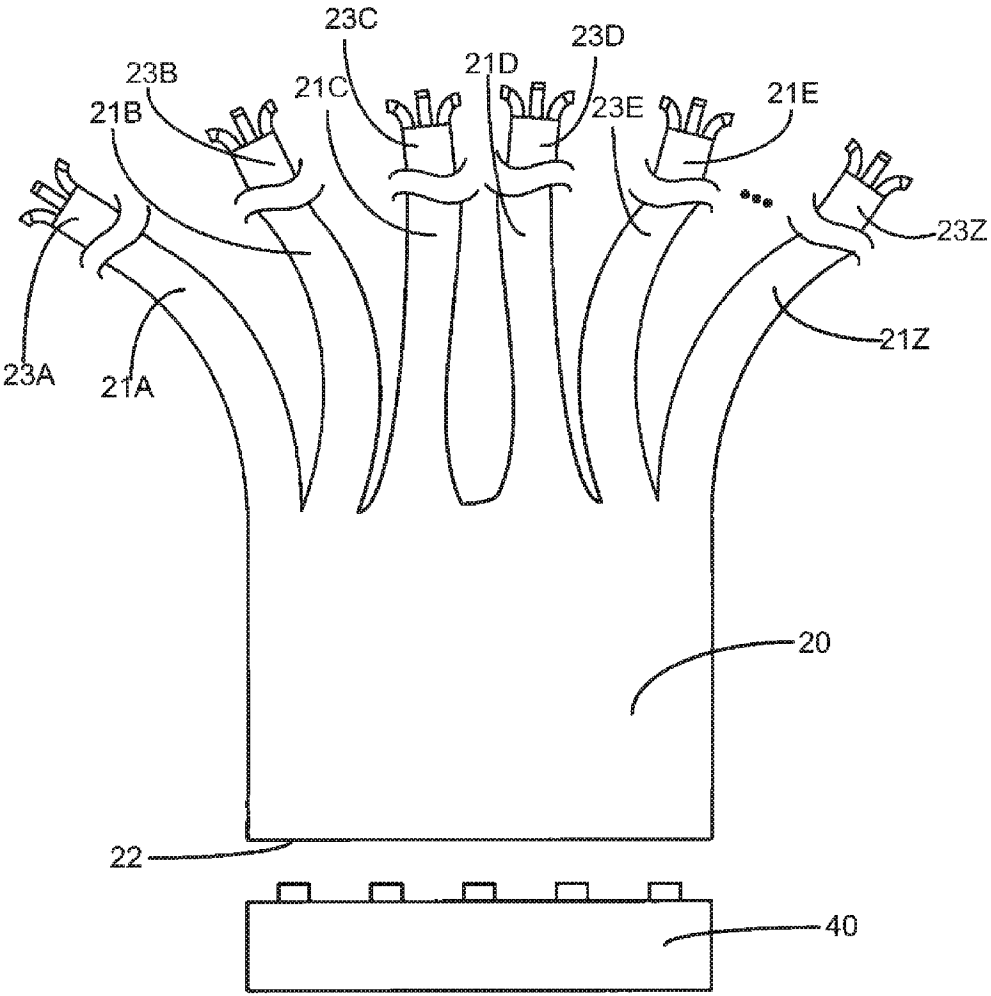
FIG. 8 is a partial side elevation view of an embodiment of the remote light wavelength conversion device according to the present invention wherein waveguides are grouped into pluralities.

Referring now to FIG. 8, an embodiment of the remote conversion device 10 of the present invention including multiple waveguide paths will now be discussed. Similar to operation of the remote conversion device 10 as discussed above, the light source 40 may emit a source light 42 to be received by the first end 22 of the waveguide 20. In this embodiment, the waveguide 20 may be separated into various waveguide pathways 21A-21Z. Each waveguide pathway 21A-21Z may share a common first end 22. However, the each waveguide pathway 21A-21Z may direct light to its own second end 23A-23Z wherein the source light 42 may be converted into a converted light 46 to illuminate its respective volumes 60.

Figure 9:
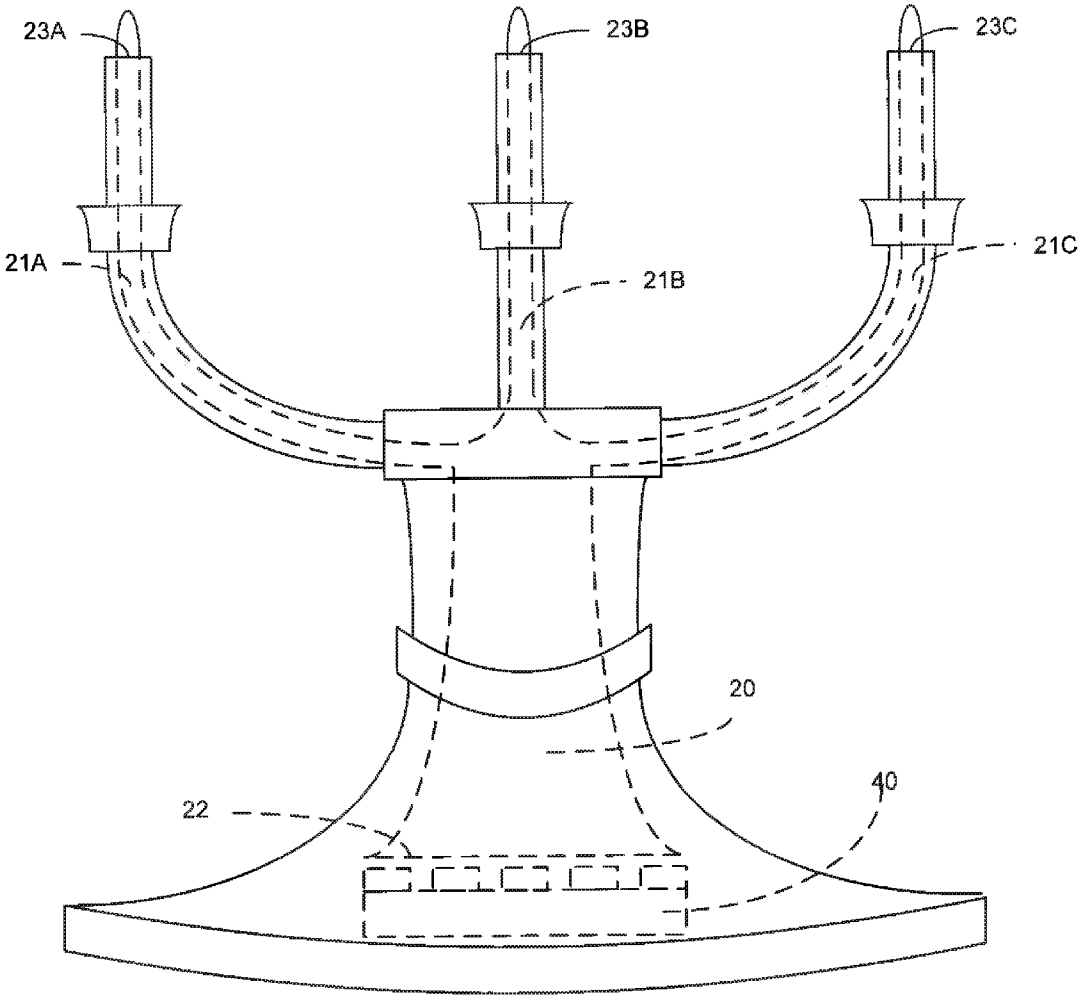
FIG. 9 is a side elevation view of an embodiment of the remote light wavelength conversion device according to the present invention wherein waveguides are grouped into pluralities included at least partially within a candelabra shaped lighting device.

Referring now to FIG. 9, an embodiment of the remote conversion device 10 of the present invention including multiple waveguide pathways 21A-21C will now be discussed. In this embodiment, the remote lighting device 10 is included within a candelabra lighting device. Similar to operation of the embodiment discussed above, the light source 40 may emit a source light 42 to be received by the first end 22 of the waveguide 20. The light source 40 and the first end 22 of the waveguide may be located at the base of the candelabra. In this embodiment, the waveguide 20 may be separated within the body of the candelabra into various waveguide pathways 21A-21C. Each waveguide pathway 21A-21C may share a common first end 22. However, each waveguide pathway 21A-21C may direct light to its own second end 23A-23C, which are depicted in FIG. 9 as the candle shaped ends. The source light 42 may be converted into a converted light 46 to illuminate a space at the respective second ends 23A-23C.

As will also be appreciated by a person of skill in the art, an additional embodiment of the present invention may include a plurality of light sources 40, which may emit a source light 42 to be received by one or more responding waveguides 20. The source light 42 received from the plurality of light sources 40 may be directed from a common location. More specifically, the first ends 22 of the waveguides 20 may be located in spatially differing locations, with each first end 22 located adjacent to a light source 40. The second ends 23 of the waveguides 20 may be collectively grouped in approximately the same spatial location. Skilled artisans will additionally appreciation embodiments wherein a plurality of light sources 40 may direct a source light 42, through the waveguide 20, to a plurality of destinations. The source light 42 may then be converted into the converted light 46.

In still an additional embodiment of the present invention, the color conversion optic 30 may be included within the bulk material of the waveguide 20, between the first end 22 and the second end 23. As the source light 42 is transmitted through the waveguide 20, at least part of it may be converted in to the converted light 46. The source light 42 and the converted light 46 may be collectively directed from the second end 23 of the waveguide 20 in the desired output direction. As a non-limiting example, a yellow color conversion material may be included in the bulk material at a position between the first end 22 and the second end 23 of the waveguide 20. As a blue source light 42 may be transmitted through the waveguide 20, at least a part of the blue source light 42 may be converted into a yellow converted light 46. The blue source light 42 and the yellow converted light 46 may be collectively directed from the second end 23 of the waveguide 20 as white light. A person of skill in the art will appreciate the inclusion of alternate and additional conversion materials within the waveguide 20 to be included within the scope and spirit of the present invention.

In an additional embodiment of the present invention, a plurality of color conversion materials may be included between the first end 22 and the second end 23 of the waveguide 20, and within the bulk material comprising the waveguide 20. Provided as a non-limiting example, the waveguide 20 may include a red color conversion optic 30 and yellow color conversion optic 30 within the bulk material of the waveguide. As a blue source light 42 may be transmitted through the waveguide 20, the source light 42 may be converted into both red and yellow converted lights 46. The red and yellow converted lights 46 may be combined with the blue source light 42 to make white light with a desired chromaticity.

Figure 10:
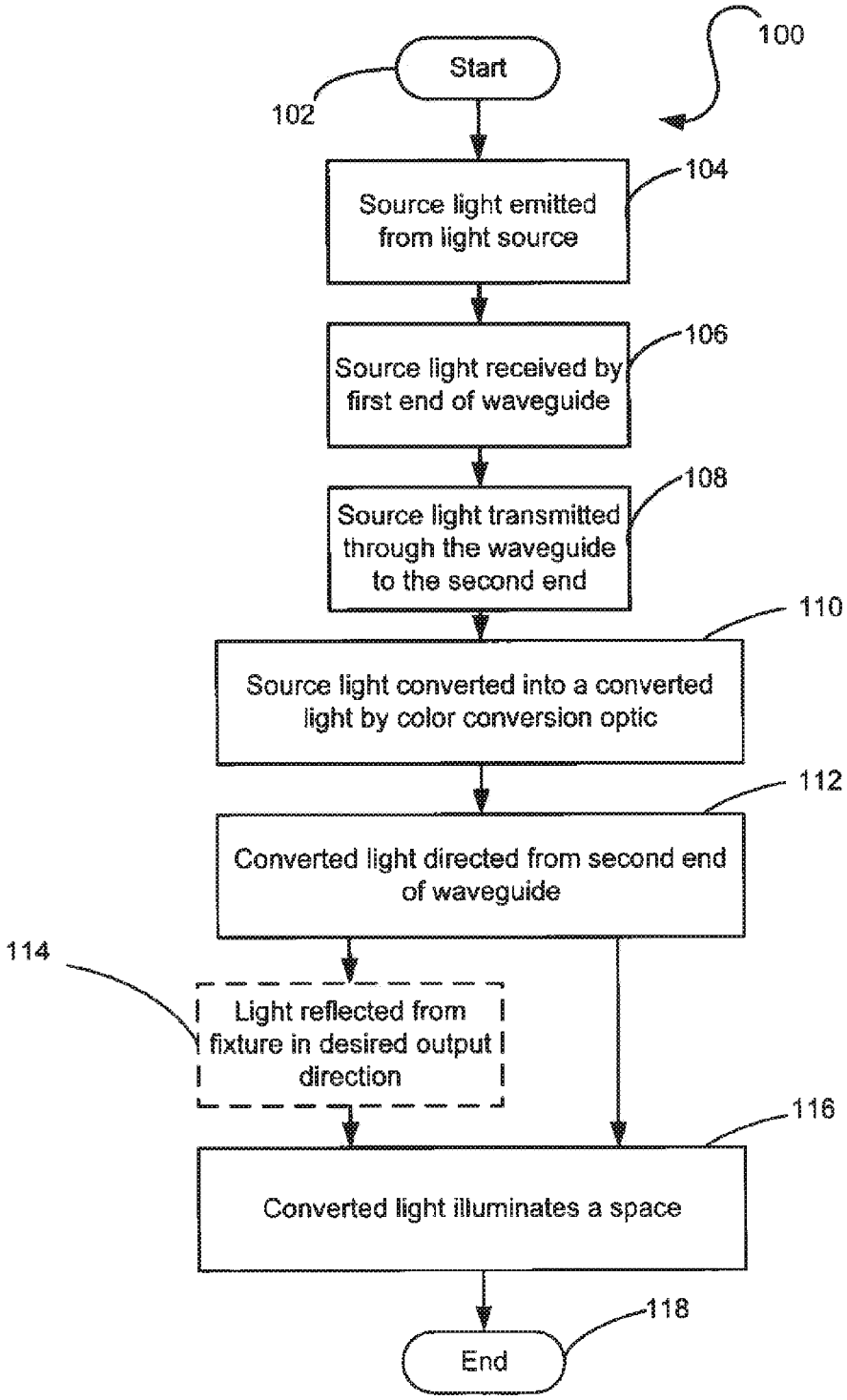
FIG. 10 is a flow chart illustrating a transmission and conversion operation according to an embodiment of the remote light wavelength conversion device of the present invention.

Focusing now to flowchart 100 of FIG. 10, an example of the transmission, conversion, and illumination resulting from the operation of the remote conversion device 10, according to an embodiment of the present invention, will now be discussed in greater detail. Starting at Block 102, a source light 42 may be emitted from a light source 40 (Block 104). The source light 42 may be received by the waveguide 20 at its first end 22 (Block 106). The source light 42 may then be transmitted from the first end 22 of the waveguide 20, through the length of the waveguide 20, and to the second end 23 of the waveguide 20, as previously discussed above (Block 108). The source light 42 may be converted by the color conversion optic 30 into a converted light 46 (Block 110). The color conversion optic 30 may be located at the second end 23 of the waveguide 20. Alternatively, the color conversion optic 30 may be located within the bulk material of the waveguide 20 between the first end 22 and the second end 23. A person of skill in the art will appreciate additional locations for the color conversion optic with respect to the waveguide that would be included within the scope and spirit of the present invention.

The converted light 46 may next be directed from the second end 23 of the waveguide 20 (Block 112). The converted light 46 may then be used to illuminate a space 60 (Block 116). Optionally, the converted light 46 may be directed into a fixture 50, as shown at Block 114, wherein the converted light 46 may be reflected in a desired output direction to illuminate the space 60 (Block 116). The transmission, conversion and illumination operation may then end at Block 118.

Figure 11:
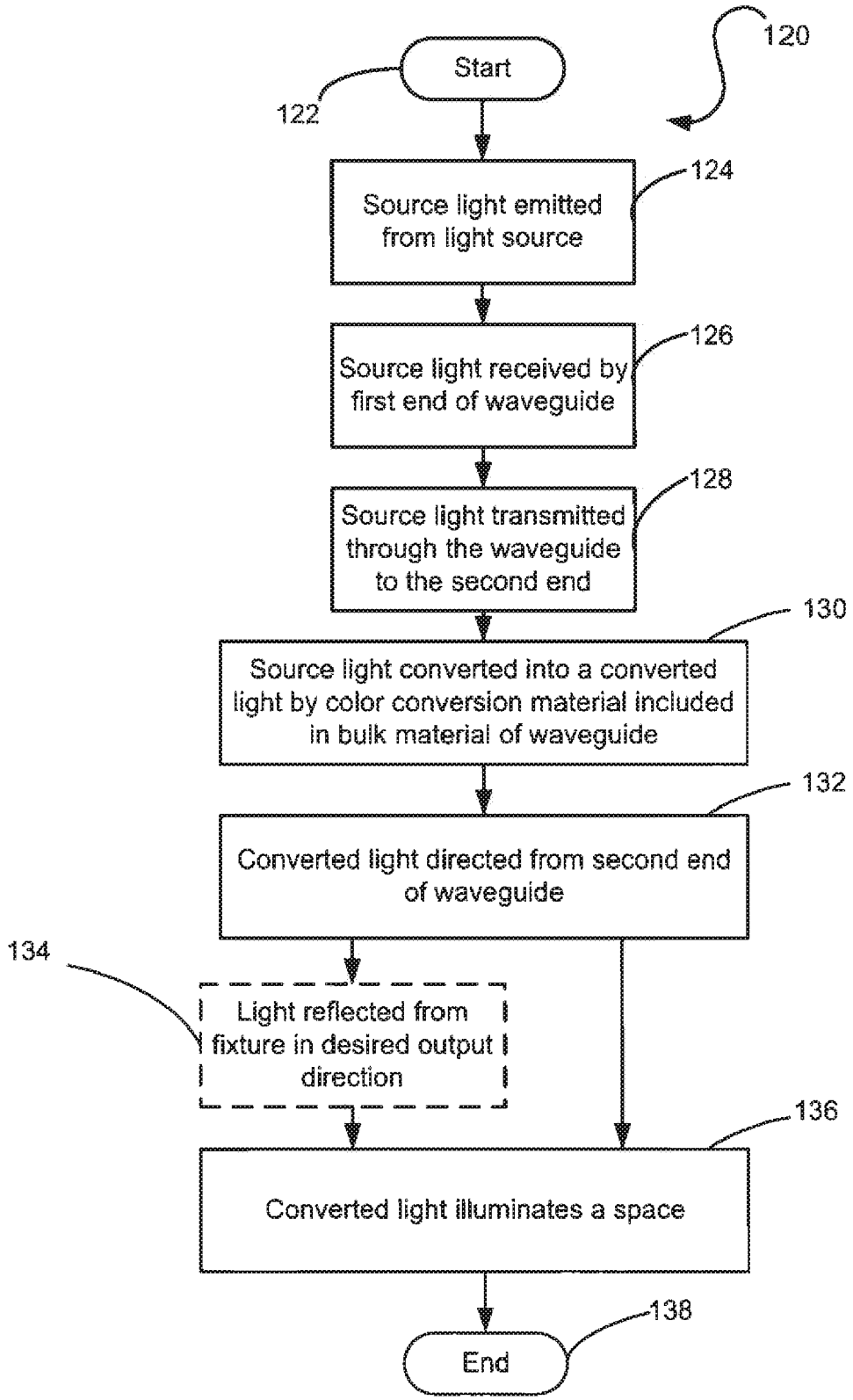
FIG. 11 is a flow chart illustrating a transmission and conversion operation according to an embodiment of the remote light wavelength conversion device of the present invention.

Referring now to the flowchart 120 of FIG. 11, an additional example of the transmission, conversion, and illumination resulting from the operation of the remote conversion device 10, according to an embodiment of the present invention, will now be discussed in greater detail. In the embodiment illustrated by the flowchart 120, the conversion material is included in the bulk material of the waveguide 20. A person of skill in the art will appreciate that the following example is provided to illustrate an embodiment of the present invention, and therefore should not be perceived as limiting.

Starting at Block 122, a source light 42 may be emitted from a light source 40 (Block 124). The source light 42 may be received by the waveguide 20 at its first end 22 (Block 126). The source light 42 may then be transmitted from the first end 22 of the waveguide 20, through the length of the waveguide 20, and to the second end 23 of the waveguide 20, as previously discussed above (Block 128). The source light 42 may be converted by the color conversion optic 30, which may be included in the bulk material of the waveguide 20, into a converted light 46. This color conversion may occur as the source light 42 is transmitted through the waveguide 20 (Block 130).

The converted light 46 may next be directed from the second end 23 of the waveguide 20 (Block 132). The converted light 46 may then be used to illuminate a space 60 (Block 136). Optionally, the converted light 46 may be directed into a fixture 50, as shown at Block 134, wherein the converted light 46 may be reflected in a desired output direction to illuminate a space 60 (Block 136). The transmission, conversion and illumination operation may then end at Block 138.

Figure 12:
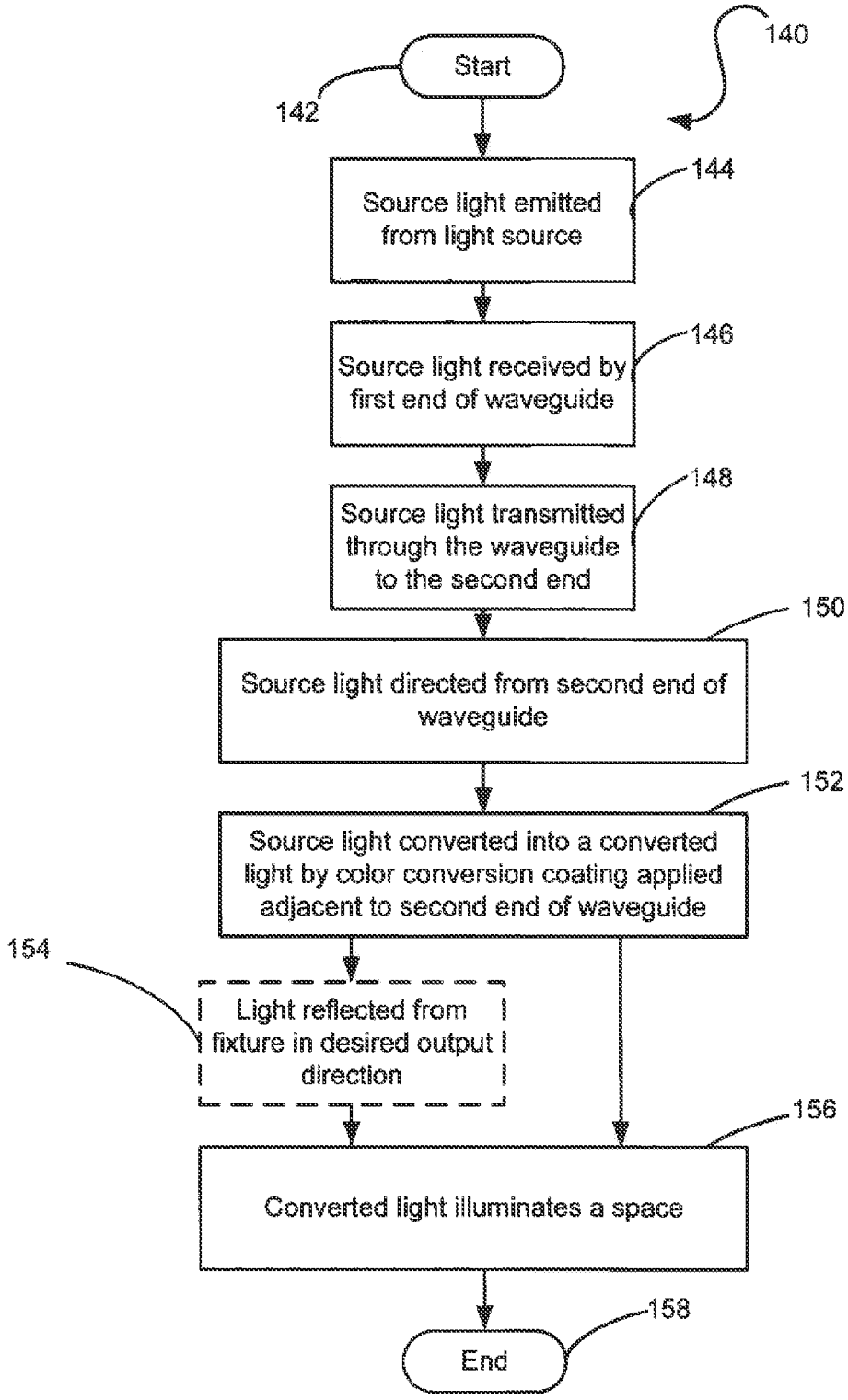
FIG. 12 is a flow chart illustrating a transmission and conversion operation according to an embodiment of the remote light wavelength conversion device of the present invention.

Referring now additionally to the flowchart 140 of FIG. 12, an example of the transmission, conversion, and illumination resulting from the operation of the remote conversion device 10, according to an embodiment of the present invention, will now be discussed in greater detail. In the embodiment illustrated by the flowchart 140, the conversion material is included as a coating, which may be applied adjacent to the second end 23 of the waveguide 20. A person of skill in the art will appreciate that the following example is provided to illustrate an embodiment of the present invention, and therefore should not be perceived as limiting.

Starting at Block 142, a source light 42 may be emitted from a light source 40 (Block 144). The source light 42 may be received by the waveguide 20 at its first end 22 (Block 146). The source light 42 may then be transmitted from the first end 22 of the waveguide 20, through the length of the waveguide 20, and to the second end 23 of the waveguide 20, as previously discussed above (Block 148). The converted light 46 may next be directed from the second end 23 of the waveguide 20 (Block 150).

The source light 42 may thereafter be converted by the color conversion optic 30 located adjacent to the second end 23 of the waveguide 20 (Block 152). The color conversion optic 30 may be included as a conversion coating applied adjacent to the second end 23 of the waveguide 20. The converted light 46 may then be used to illuminate a space 60 (Block 156). Optionally, the converted light 46 may be directed into a fixture 50, as shown at Block 154, wherein the converted light 46 may be reflected in a desired output direction to illuminate a space 60 (Bock 156). The transmission, conversion and illumination operation may then end at Block 158

By isolating the heat generating elements, such as the light source 40, from the color conversion optic 30, the remote conversion device 10, according to an embodiment of the present invention, may beneficially reduce the quantity of the color conversion material that may be applied to the color conversion optic 30. This reduction of color conversion material required to convert the source light 42 into the converted light 46 may advantageously provide increased efficiency and decreased cost of material.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A remote light wavelength conversion device for converting a source light emitted from a light source within a source wavelength range into a converted light within a converted wavelength range, the remote wavelength conversion device comprising:

a waveguide including a first end and a second end opposite the first end; and a color conversion optic to convert the source light transmitted through the waveguide from the first end to the converted light at the second end;

wherein the source light is transmitted from the first end of the waveguide to the second end of the waveguide; and wherein the color conversion optic comprises a plurality of interchangeable color conversion optics.

2. A device according to claim 1 wherein the waveguide is an optical fiber.

3. A device according to claim 2 wherein the optical fiber is a single mode fiber.

4. A device according to claim 1 wherein the color conversion optic includes a conversion material selected from a group consisting of phosphors, quantum dots, luminescent materials, and fluorescent materials.

5. A device according to claim 1 wherein the color conversion optic is located adjacent to the second end of the waveguide.

6. A device according to claim 1 wherein the converted wavelength range affects melatonin production.

7. A device according to claim 1 wherein each one of the plurality of interchangeable color conversion optics corresponds to a desired output color; and wherein the plurality of interchangeable color conversion optics is selectable to convert the source light into the converted light with the desired output color being defined by the converted wavelength range.

8. A device according to claim 1 wherein each one of the plurality of interchangeable color conversion optics corresponds to a desired output color; and wherein the plurality of interchangeable color conversion optics is selectable to convert the source light into the converted light with the desired output color being defined by a chromaticity.

9. A device according to claim 1 wherein the source light is monochromatic.

10. A device according to claim 1 wherein the source light includes high energy light defined within the source wavelength range between 200 and 500 nanometers.

11. A device according to claim 10 wherein at least part of the high energy light included in the source light is converted to low energy light to be included in the converted light.

12. A device according to claim 1 wherein the source light includes low energy light defined within the source wavelength range between 500 and 1300 nanometers.

13. A device according to claim 12 wherein at least part of the low energy light included in the source light is converted to high energy light to be included in the converted light.

14. A device according to claim 12 wherein the source light further includes high energy light defined within the source wavelength range between 200 and 500 nanometers.

15. A device according to claim 1 wherein an optical fixture is adjacently located to the second end of the waveguide to provide a light distribution pattern.

16. A device according to claim 1 wherein the light source is a light emitting semiconductor.

* * * * *